US010269220B2

(12) United States Patent
Harpur et al.

(10) Patent No.: US 10,269,220 B2
(45) Date of Patent: Apr. 23, 2019

(54) NETWORKED BINGO WITH SUPPLEMENTARY WIN FEATURES

(71) Applicant: Pridefield Limited, Douglas, Isle of Man (GB)

(72) Inventors: Rory Harpur, Durban (ZA); Rory Smith-Belton, Bulwer (ZA)

(73) Assignee: Pridefield Limited, Douglas, Isle of Man (GB)

( * ) Notice: Subject to any disclaimer, the term of this patent is extended or adjusted under 35 U.S.C. 154(b) by 211 days.

(21) Appl. No.: 15/392,940

(22) Filed: Dec. 28, 2016

(65) Prior Publication Data

US 2017/0213414 A1 Jul. 27, 2017

(30) Foreign Application Priority Data

Jan. 25, 2016 (GB) ..... 1601304.7

(51) Int. Cl.
*A63F 3/06* (2006.01)
*G07F 17/32* (2006.01)

(52) U.S. Cl.
CPC ..... *G07F 17/329* (2013.01); *A63F 3/0645* (2013.01); *G07F 17/3225* (2013.01); *G07F 17/3244* (2013.01); *G07F 17/3267* (2013.01); *G07F 17/3276* (2013.01); *A63F 3/06* (2013.01); *A63F 3/062* (2013.01); *G07F 17/3262* (2013.01)

(58) Field of Classification Search
CPC ..... A63F 3/06; A63F 3/062; A63F 3/0645; G07F 17/329; G07F 17/3262; G07F 17/3244
See application file for complete search history.

(56) References Cited

U.S. PATENT DOCUMENTS 4,743,022 A 5/1988 Wood
4,760,527 A 7/1988 Sidley
(Continued)

FOREIGN PATENT DOCUMENTS

EP 2902981 8/2015

OTHER PUBLICATIONS

Australian Patent Office, Examination Report No. 1 dated Oct. 20, 2017, issued in connection with AU Application No. 2017200275, 2 pages.

(Continued)

*Primary Examiner* — William H McCulloch, Jr.
(74) *Attorney, Agent, or Firm* — McDonnell Boehnen Hulbert & Berghoff LLP

(57) ABSTRACT

A gaming server device may conduct a networked bingo game with client devices, each client device associated with a respective bingo ticket. Conducting the game may involve: (i) randomly selecting symbols from the symbol set, (ii) marking the selected symbols on any bingo tickets that contain the selected symbols, and (iii) repeating the random selecting and marking until one or more of the bingo tickets are marked with a winning pattern. The gaming server device may transmit an offer to a particular client device associated with a particular bingo ticket that is not marked with the winning pattern. The offer may be for the gaming server device to randomly select a further symbol from the symbol set at a cost to the particular client device, where the cost is based on an expected gain that acceptance of the offer provides to the particular client device.

19 Claims, 9 Drawing Sheets

(56) References Cited

U.S. PATENT DOCUMENTS 5,042,818 A 8/1991 Weingardt
5,072,381 A * 12/1991 Richardson ..... G07F 17/3225 273/237
5,275,400 A * 1/1994 Weingardt ..... A63F 3/081 273/143 R
5,704,835 A 1/1998 Dietz, II
5,947,822 A 9/1999 Weiss
6,142,872 A * 11/2000 Walker ..... G07F 17/32 340/323 R
6,146,271 A * 11/2000 Kadlic ..... A63F 1/00 273/292
6,244,958 B1 * 6/2001 Acres ..... G07F 17/32 463/16
6,416,407 B1 7/2002 Carrico et al.
7,393,278 B2 7/2008 Gerson et al.
7,442,123 B2 * 10/2008 Brill ..... G07F 17/3244 273/139
7,500,914 B2 * 3/2009 Rodgers ..... G07F 17/32 463/16
7,614,948 B2 11/2009 Saffari et al.
7,819,742 B2 * 10/2010 Chamberlain ..... G06Q 20/10 463/16
8,231,458 B2 * 7/2012 Baerlocher ..... G07F 17/32 273/138.2
8,303,390 B2 11/2012 Naicker
8,308,538 B2 11/2012 Naicker
8,460,082 B2 * 6/2013 Harris ..... G07F 17/34 463/16
8,550,894 B2 * 10/2013 Lange ..... G07F 17/3223 463/19
8,597,096 B2 12/2013 Naicker
8,858,322 B2 * 10/2014 Hayden ..... G07F 17/3274 463/25
8,932,121 B2 1/2015 Naicker
8,936,509 B2 1/2015 Naicker
8,956,216 B1 * 2/2015 LeSourd ..... G07F 17/3213 463/20
9,317,991 B2 * 4/2016 Macbeth ..... G07F 17/32
9,327,185 B2 * 5/2016 Elias ..... A63F 3/0645
9,401,074 B2 * 7/2016 Macbeth ..... G07F 17/3225
9,652,930 B2 * 5/2017 Macbeth ..... G07F 17/3225
2001/0031659 A1 * 10/2001 Perrie ..... A63F 3/00075 463/18
2002/0043759 A1 * 4/2002 Vancura ..... A63F 9/183 273/139
2002/0045474 A1 * 4/2002 Singer ..... G07F 17/32 463/20
2003/0155715 A1 8/2003 Walker et al.
2004/0038733 A1 * 2/2004 Walker ..... G06Q 30/0209 463/25
2004/0235555 A1 * 11/2004 Yarbrough ..... G07F 17/32 463/19
2005/0026665 A1 2/2005 Gerrard et al.
2005/0037832 A1 * 2/2005 Cannon ..... G07F 17/32 463/18
2005/0059451 A1 3/2005 Shackleford
2005/0164772 A1 7/2005 Lind et al.
2005/0187014 A1 * 8/2005 Saffari ..... A63F 13/00 463/27
2005/0209001 A1 9/2005 Moshal
2006/0025199 A1 2/2006 Harkins et al.
2006/0035700 A1 * 2/2006 Van Asdale ..... G07F 17/32 463/19
2006/0119044 A1 6/2006 Kekempanos et al.
2006/0149561 A1 7/2006 Govender
2006/0252512 A1 11/2006 Walker et al.
2007/0155460 A1 7/2007 Burnside et al.
2007/0262528 A1 11/2007 McKee
2007/0265058 A1 11/2007 Govender et al.
2008/0111309 A1 5/2008 Nicely et al.
2008/0234028 A1 * 9/2008 Meyer ..... G07C 15/005 463/17
2009/0011814 A1 * 1/2009 Lozano ..... G07F 17/32 463/19
2009/0247259 A1 * 10/2009 Napolitano ..... G07F 17/3244 463/18
2011/0230249 A1 * 9/2011 Harris ..... G07F 17/34 463/19
2011/0287823 A1 * 11/2011 Guinn ..... G07F 17/3258 463/19
2012/0172103 A1 * 7/2012 Gurule ..... G07F 17/3258 463/17
2012/0231867 A1 * 9/2012 Dimitriadis ..... G07F 17/32 463/19
2012/0231868 A1 * 9/2012 Guinn ..... G07F 17/3274 463/20
2012/0244927 A1 9/2012 Weatherby et al.
2013/0023324 A1 * 1/2013 Lange ..... G07F 17/32 463/19
2013/0296060 A1 * 11/2013 Hayden ..... G07F 17/3225 463/42
2014/0197598 A1 * 7/2014 King ..... A63F 3/062 273/269
2014/0274278 A1 * 9/2014 Elias ..... A63F 3/0645 463/19
2014/0274279 A1 * 9/2014 Macbeth ..... G07F 17/32 463/19
2014/0274280 A1 * 9/2014 Macbeth ..... G07F 17/3225 463/19
2015/0209658 A1 * 7/2015 Elias ..... A63F 3/0645 463/19
2015/0213672 A1 * 7/2015 Elias ..... G07F 17/329 463/19
2015/0213673 A1 * 7/2015 Elias ..... A63F 3/062 463/19
2015/0221162 A1 * 8/2015 Peters ..... A63F 3/0645 463/19
2016/0210809 A1 * 7/2016 Elias ..... A63F 3/0645
2016/0210810 A1 * 7/2016 Macbeth ..... G07F 17/32
2016/0300427 A1 * 10/2016 Elias ..... G07F 17/329
2016/0314650 A1 * 10/2016 Macbeth ..... G07F 17/3225
2016/0346674 A1 * 12/2016 Elias ..... A63F 3/062
2017/0053474 A1 * 2/2017 Harris ..... G07F 17/329
2017/0213414 A1 * 7/2017 Harpur ..... G07F 17/3225

OTHER PUBLICATIONS

United Kingdom Intellectual Property Office, Search Report dated Jul. 17, 2017, issued in GB Application No. 1601304.7, 5 pages.
European Patent Office, European Search Report dated Jun. 6, 2017, issued in connection with EP Application No. 17153141, 8 pages.
Australian Patent Office, Office Action dated Jun. 30, 2011, issued in connection with Australian Patent Application No. 2010224425, 2 pages.
David Benefield: Poker Blog, "Multiaccounting," CardRunners Blog Network, http://blogs.cardrunners.com/davidb/Multiaccounting, Sep. 12, 2008.
Notice of Allowance dated Aug. 1, 2012, issued in connection with U.S. Appl. No. 12/580,607, filed Oct. 16, 2009, 21 pages.
Non-Final Office dated Apr. 5, 2012, issued in connection with U.S. Appl. No. 12/580,607, filed Oct. 16, 2009, 20 pages.
Final Office dated Jun. 29, 2012, issued in connection with U.S. Appl. No. 12/580,615, filed Oct. 16, 2009, 18 pages.
Notice of Allowance dated Aug. 31, 2012, issued in connection with U.S. Appl. No. 12/580,615, filed Oct. 16, 2009, 21 pages.
Non-Final Office dated Feb. 29, 2012, issued in connection with U.S. Appl. No. 12/580,615, filed Oct. 16, 2009, 15 pages.
Advisory Action dated Sep. 18, 2012, issued in connection with U.S. Appl. No. 12/703,960, filed Feb. 11, 2010, 4 pages.
Final Office Action dated Jul. 11, 2012, issued in connection with U.S. Appl. No. 12/703,960, filed Feb. 11, 2010, 14 pages.
Notice of Allowance dated Oct. 10, 2013, issued in connection with U.S. Appl. No. 12/703,960, filed Feb. 11, 2010, 7 pages.
Non-Final Office Action dated Feb. 27, 2012, issued in connection with U.S. Appl. No. 12/703,960, filed Feb. 11, 2010, 12 pages.

(56) References Cited

OTHER PUBLICATIONS

Non-Final Office Action dated Aug. 20, 2013, issued in connection with U.S. Appl. No. 12/703,960, filed Feb. 11, 2010, 6 pages.
Notice of Allowance dated Nov. 26, 2014, issued in connection with U.S. Appl. No. 13/644,820, filed Oct. 4, 2012, 5 pages.
Non-Final Office Action dated Aug. 11, 2014, issued in connection with U.S. Appl. No. 13/644,820, filed Oct. 4, 2012, 12 pages.
Notice of Allowance dated Dec. 8, 2014, issued in connection with U.S. Appl. No. 13/648,020, filed Oct. 9, 2012, 5 pages.
Non-Final Office Action dated Aug. 7, 2014, issued in connection with U.S. Appl. No. 13/648,020, filed Oct. 9, 2012, 14 pages.
"Two Plus Poker Forums—Poll: Should anonymity be allowed in Rush Poker," p. 1 of 2, http://forumserver.twoplustwo.com/28/internet-poker/poll-should-anonymity-allowed-rush-poker-694741, Jan. 29, 2010, 34 pages.
"Two Plus Poker Forums—Poll: Should anonymity be allowed in Rush Poker," p. 2 of 2, http://forumserver.twoplustwo.com/28/internet-poker/poll-should-anonymity-allowed-rush-poker-694741, Jan. 29, 2010, 29 pages.

* cited by examiner

NETWORKED BINGO WITH SUPPLEMENTARY WIN FEATURES

CROSS-REFERENCE TO RELATED APPLICATION

This application claims priority to U.K. Intellectual Property Office (UKIPO) patent application no. 1601304.7, filed Jan. 25, 2016, which is hereby incorporated by reference in its entirety.

BACKGROUND

The Internet and other data networks have facilitated the growth of real-time or near-real-time networked gaming. Players from around the world can log on to a gaming server and enjoy competing against one another in a computer-mediated contest over a computer network, such as the Internet. These matches can be played for fun, entertainment, or for gain.

Bingo is a game of chance involving two or more players. Traditional bingo is played on predetermined "tickets" in the form of paper cards that include a number of symbols selected from a global symbol set and arranged in a row-and-column grid, each grid position containing a symbol. Each ticket generally includes a subset of symbols in the global symbol set. A symbol may be a number selected randomly and without replacement from a number range, for example the number range of 1 through 90. Each bingo ticket contains a different combination and arrangement of symbols. Each bingo ticket may also contain one or more "free" spaces that are not associated with a symbol.

During play of a bingo match, symbols are selected randomly, generally without replacement, from the global symbol set and matched to the symbols on each ticket. A ticket having matching symbols arranged in a pre-defined pattern is a winning ticket and qualifies for the award of a prize. The match ends when one of the players' tickets is the first to exhibit a pre-defined pattern of grid markings. A common match-ending pattern is for all of the grid positions on a ticket to be marked. However other match-ending patterns may be defined. The winner of the match is usually the first player to achieve the match-ending pattern.

SUMMARY

A disadvantage of bingo games is that the probability of winning a prize, or losing the cost of purchasing a ticket, is always determined by a fixed set of constraints, which include the number of symbols in the global symbol set, the pre-defined pattern of symbols to be matched on a ticket, and the number of grid positions on the ticket.

Like many games of chance, bingo has been implemented and deployed so that it can be played over computer networks. Networked bingo has the advantage of reaching a market segment of players who would prefer to play bingo from the comfort of their own homes. Operators of networked bingo matches compete with one another for players. The more players that play with a given operator, the more revenue that operator is able to generate. Therefore, operators of networked bingo matches seek to differentiate their services by offering new and unique variations of bingo that may attract more players. It is desirable to enhance bingo-type games with additional features that provide bingo players with additional winning opportunities, thereby increasing players' interest, anticipation and excitement in connection with the game.

To this end, the operation of new types of bingo matches between players over a network such as the Internet can more easily facilitate the development and market testing of these matches, due to the ability of the networks to rapidly reach a large and targeted market of players. Disclosed herein are systems and methods that relate to supplementary win features in a bingo-style game.

In the example embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the internet.

An example embodiment of such a networked bingo game includes a server device, a database, a number of web portals, and a number of client devices coupled to the server device via a communication network, and the database storing profiles associated with each player. Players, operating the client devices, request to join a networked bingo match. Each iteration of the match involves the server device randomly selecting a symbol from the set of symbols and then checking each bingo ticket of each player to determine if the symbol appears on the ticket. If the symbol appears on the ticket, the grid position on the ticket containing the symbol is marked. Furthermore, the server device checks if the match has been won by a ticket (i.e., by having the pre-defined pattern of matching symbols) and, if so, activates a supplementary game feature that offers any non-winning ticket an opportunity of being awarded a prize.

In a first aspect, an example embodiment may involve conducting, by a gaming server device, a real-time networked bingo game with a plurality of client devices, each client device associated with a respective bingo ticket. The respective bingo tickets may contain respective arrangements of symbols from a symbol set. Conducting the real-time networked bingo game may further involve: (i) randomly selecting symbols from the symbol set, (ii) marking the selected symbols on any bingo tickets, of the plurality of bingo tickets, that contain the selected symbols, and (iii) repeating the random selecting and marking until one or more of the plurality of bingo tickets are marked with a winning pattern. The example embodiment may also involve transmitting, by the gaming server device, indications of awarded prizes to client devices associated with the bingo tickets marked with the winning pattern. The example embodiment may further involve transmitting, by the gaming server device, an offer to a particular client device associated with a particular bingo ticket that is not marked with the winning pattern. The offer may be for the server device to randomly select a further symbol from the symbol set at a cost to the particular client device, and the cost may be based on an expected gain that acceptance of the offer provides to the particular client device. The example embodiment may additionally involve receiving, by the gaming server device, the acceptance of the offer.

Viewed from a second aspect, the disclosure provides an article of manufacture including a non-transitory computer-readable medium, having stored thereon program instructions that, upon execution by a gaming server device, cause the gaming server device to perform the operations of the first aspect.

Viewed from a third aspect, the disclosure provides a gaming server device configured to perform the operations of the first aspect.

Viewed from a fourth aspect, the disclosure provides a system comprising means for performing the operations of the first aspect.

Viewed from a fifth aspect, the disclosure provides a gaming system that comprises a plurality of gaming devices each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more gaming device processors; and one or more gaming device memory devices storing (i) a plurality of bingo tickets, each associated with one of the gaming devices, wherein each bingo ticket of the plurality of bingo tickets contains a respective arrangement of symbols from a symbol set, and (ii) a plurality of gaming device instructions executable by the one or more gaming device processors to perform the operations of the first aspect.

These and other aspects and advantages will become apparent to those of ordinary skill in the art by reading the following detailed description, with reference where appropriate to the accompanying drawings. Further, it should be understood that the foregoing overview is merely for purposes of illustration and is not intended to limit the scope of the invention as claimed.

DETAILED DESCRIPTION

I. Introduction

This description provides several example embodiments pertaining to networked bingo games. The implementation of the described networked bingo games affords operators of these games options and variations that are not possible or practical in traditional, non-networked bingo play. In order to support these options and variations, networked bingo can be formally described in more general terms than those used in traditional bingo. Accordingly, networked bingo may use one or more variations of match play, and a prize or prizes (i.e., award(s)). These elements are described in more detail below, and may be combined in various ways to define new methods, devices, and systems for networked bingo.

In this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using those articles is that there is one or more of the elements. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements. For purpose of this description, the terms "multiple" and "a plurality of" refer to "two or more" or "more than one."

Any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

The block diagram(s) and flow chart(s) shown in the figures are provided merely as examples and are not intended to be limiting. Many of the elements illustrated in the figures or described herein are functional elements that can be implemented as discrete or distributed elements or in conjunction with other elements, and in any suitable combination and location. Those skilled in the art will appreciate that other arrangements and elements (e.g., machines, interfaces, operations, orders, or groupings of operations) can be used instead. Furthermore, various operations described as being performed by one or more elements can be carried out by a processor executing computer-readable program instructions or by any combination of hardware, firmware, or software.

II. Symbol Sets for Networked Bingo

Figure 4:
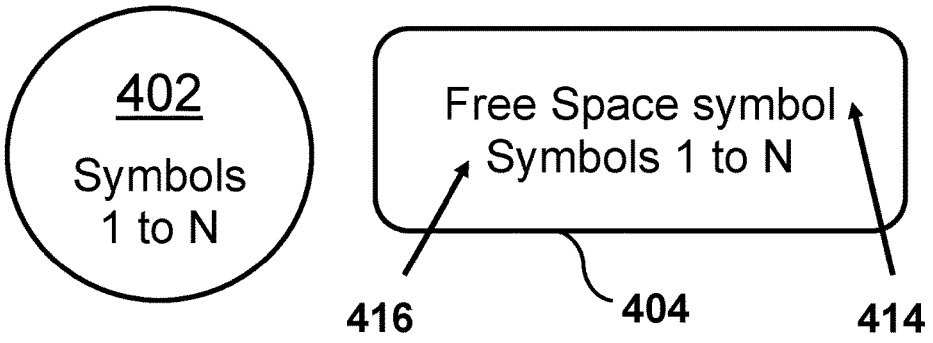
FIG. 4 is a pictorial representation of symbol sets for a networked bingo match in accordance with example embodiments.

Multiple sets of symbols can be defined for networked bingo using bingo strips or bingo tickets. FIG. 4 shows a pictorial representation of sets of symbols (or more simply, "symbol sets") 402 and 404. Symbol sets 402, and 404 can include computer-readable symbols stored in a computer-readable data storage device.

Symbol set 402 is a set of symbols from which symbols for a networked bingo match can be selected by a processor. Symbol set 402 can include symbols representing whole numbers 1 to N. As an example, to be similar to a first traditional version of bingo, N can be 75 so that symbol set 402 includes symbols representing the numbers 1 through 75, inclusive. As another example, to be similar to a second traditional version of bingo, N can be 90 so that symbol set 402 includes symbols representing the numbers 1 through 90, inclusive. Symbol set 402 can include symbols selectable for generating a bingo ticket.

The example embodiments of networked bingo described herein are configurable such that the value of N is 75, 90, or some other number. Moreover, in example embodiments of networked bingo described herein, the symbols are not restricted to being numbers or numerical values, but may include letters, punctuation marks, symbols from phonemic, syllabic, or logographic alphabets or writing systems, pictures, or any other representation of information.

Symbol set 404 can include a symbol set 416 that matches symbol set 402, and one or more other symbols that are selectable for generating a bingo ticket or ticket. Symbol set 416 can be a proper subset of symbol set 404. As an example, the one or more other symbols can include a free space symbol 414.

One or more of symbol sets used in the example networked bingo games may be non-repeating or repeating. For non-repeating sets of symbols, each symbol appears exactly once in the set, while in repeating sets of symbols, each symbol may appear in the set more than once.

While in traditional bingo, the symbols are usually represented on physical balls, in a computerized networked bingo match, there is no need for physical balls and instead the symbols may be represented in various ways in computer memory and displayed on a computer screen or some other medium.

III. Bingo Tickets and Bingo Strips

Each player of a networked bingo match is provided one or more bingo tickets to be used in a networked bingo match. Each player may choose, purchase, or be given their bingo ticket(s). Each bingo ticket includes a grid with multiple grid positions. Each grid position on or within the grid includes one or more symbols chosen from a set of symbols defined for generating a bingo ticket (e.g., the symbol set 404).

Providing a bingo ticket to a player can include providing the bingo ticket to a machine for the player (or more simply, the "player's machine"). A server machine that generates a bingo ticket can transmit the bingo ticket to a communication network for transmission, in turn, to the machine for the player. The bingo ticket is a computer-readable bingo ticket. The player's machine can be configured to display the bingo ticket provided thereto. The player's machine can include or be coupled to a printing device to provide a printed copy of a bingo ticket provided to the player's machine.

A bingo ticket can include one or more grids. Each grid is displayable as having a grid shape, such as, but not limited to, a square, a rectangle, a diamond, or an irregular shape. Each grid can be configured as or include a grid matrix (or more simply, a "matrix") having X rows, Y columns, and X times Y grid positions. As an example, X and Y each equal 5 such that the grid includes a 5-by-5 matrix with 5 rows, 5 columns, and 25 grid positions. As another example, X equals 3 and Y equals 9 such that the grid includes a 3-by-9 matrix with 3 rows, 9 columns, and 27 grid positions.

Each grid position can be selected to include a symbol from the symbol set 404. The symbols in the grid positions may be chosen from symbol set 416 either with or without replacement. If the symbols are chosen with replacement, each symbol may appear more than one time on a bingo ticket. If the symbols are chosen without replacement, each symbol may appear no more than once on each bingo ticket. Additional symbols of symbol set 404, such as symbols indicating a "free space", may appear in any position on a bingo ticket. The distribution of symbols to bingo ticket grid positions may be pre-chosen or dynamically chosen, preferably randomly or pseudo-randomly chosen. Thus, bingo tickets may be generated and stored for later use, or may be generated in real time, as needed.

It can be appreciated that a wide variety of types of bingo tickets can be created in accordance with this definition. For a particular embodiment of bingo, symbol set 416 can include 90 symbols representing the numbers 1 through 90. Each row of a bingo ticket including the 3-by-9 matrix described above can include 5 grid positions including symbols from symbol set 416 and 4 grid positions including "free space" symbols. Each of those bingo tickets includes 15 symbols from symbol set 416. Each of the 15 symbols being randomly associated with one of the 27 grid positions on the bingo ticket.

A number of bingo tickets, for example 6 bingo tickets, may be grouped together. Such a grouping is called a bingo "strip". In the example embodiment in which symbol set 402 includes 1 to N symbols and N equals 90, a bingo strip can include each distinct symbol from 1 to 90 in a respective grid position on the bingo strip only once. In accordance with at least some of the example embodiments, for every symbol "called" in the bingo match, at least one grid position may be marked across the 6 bingo tickets in the strip. Of course, many other variations of networked bingo, either including tickets or not including tickets, may be defined.

Figure 3:
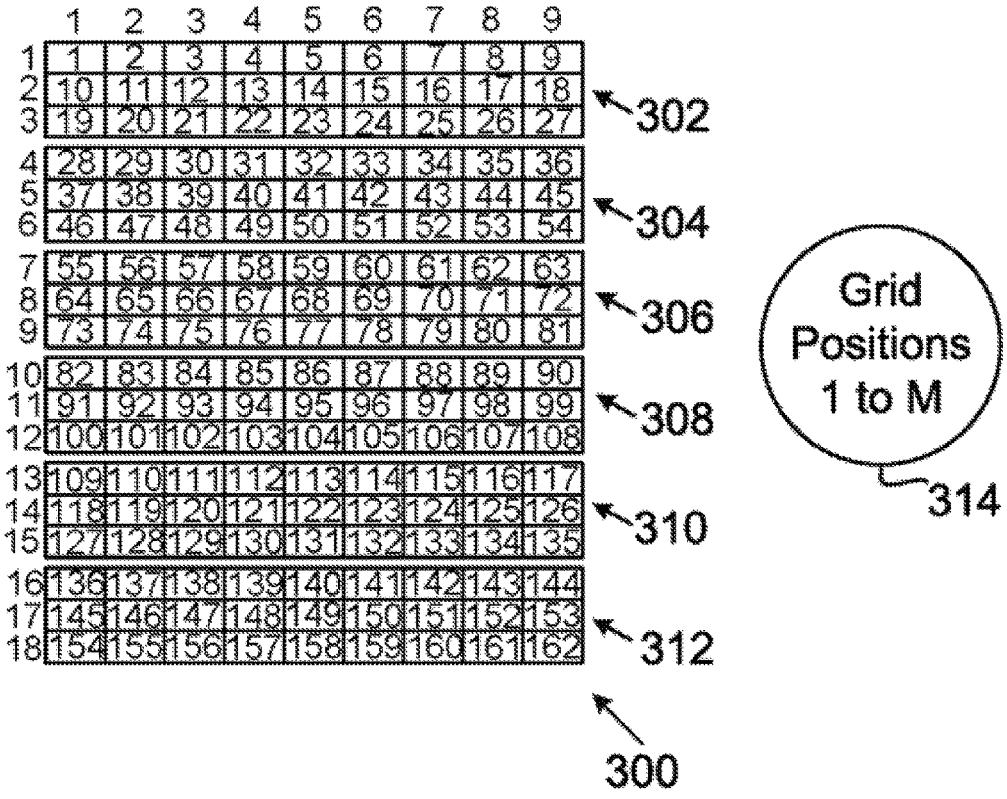
FIG. 3 depicts an example bingo strip and data structure storing grid position identifiers in accordance with example embodiments.

FIG. 3 depicts an example bingo strip 300 including bingo tickets 302, 304, 306, 308, 310, and 312 (or more simply, "bingo tickets 302 to 312"). Each of the bingo tickets 302 to 312 includes a 3-by-9 matrix and 27 grid positions. The row numbers for bingo tickets 302 to 312 are numbered 1 to 18, inclusive, and the column numbers for bingo tickets 302 to 312 are numbered 1 to 9, inclusive.

A bingo strip includes M grid positions. For bingo strip 300, M equals 162. Each grid position can be identified using any of a variety of grid identifiers. As an example, M grid positions of bingo strip 300 can be numbered 1 to 162, inclusive. A different grid position identification scheme can be used. For instance, the grid positions can be identified by a row identifier and a column identifier. For example, grid position 111 could be identified as grid position (13, 3) where the row is listed before the column, or grid position (3, 13) where the column is listed before the row. The grid identifiers for grid positions 1 to M can be stored in a data storage device as grid positions 314.

For a bingo match in which a symbol from symbol set 402 is selected with replacement, a bingo ticket can be generated to have multiple instances of a single symbol from the symbol set 416. Each time the single symbol is selected for the bingo match, each grid position including the symbol can be marked.

IV. Networked Bingo Matches

Networked bingo can be played in various ways. An example method of match play is for each player to use one or more bingo tickets in a match. Each bingo ticket begins unmarked, except for "free" spaces that are either pre-marked by default or otherwise considered to be marked for purposes of scoring. Players may be required to purchase the one or more bingo tickets as a fee for entry into a game. From these fees, the networked bingo operator may collect a percentage, or "rake," which contributes to the operator's revenue.

Each iteration, or turn, of a match consists of a new or next symbol being chosen from symbol set 402. The symbols may be chosen either with or without replacement. If the symbols are chosen with replacement, each symbol may be chosen more than once per match. If the symbols are chosen without replacement, each symbol may be chosen no more than once per match. Once a symbol is chosen, it may be "called" or otherwise indicated to the players, preferably over a communication network. Additionally, each bingo ticket of each player in the match may be checked to determine if the bingo ticket contains the called symbol in a grid position. If the bingo ticket includes the called symbol, the symbol is preferably marked on the ticket. This marking may take the form of highlighting the symbol in some fashion, such as changing its color, graying it out, circling it, or otherwise indicating that the symbol has been chosen from the set of symbols. A sequence of chosen symbols may be pre-chosen or dynamically chosen, preferably randomly or pseudo-randomly chosen. These iterations of "calling" and marking continue until the bingo match concludes.

The act of marking a bingo ticket may be referred to as "daubing." In traditional bingo a player must "daub" the appropriate positions on his or her bingo tickets as each symbol is "called." However, in networked bingo, a player may be required to "daub," or the networked bingo game may automatically "daub" (i.e., mark) the appropriate positions on each player's bingo tickets.

Networked bingo match play can further include one or more match-ending patterns as well as one or more optional intermediate patterns. A match-ending pattern is preferably a pattern of markings on a bingo ticket that, when achieved on a bingo ticket, causes the bingo match to end. A typical match-ending pattern is a pattern on a bingo ticket having all grid positions, including both grid positions with symbols from the set of symbols as well as any "free space" grid positions, having been marked. Other match-ending patterns may be defined, however.

Preferably, a player using a machine displaying a bingo ticket that first achieves a match-ending pattern wins the bingo match. It is possible for more than one player to achieve the match-ending pattern on the same iteration of the bingo match. In this case, all of the players achieving the match-ending pattern may be considered to have won the match.

An intermediate pattern is preferably a pattern of markings on a bingo ticket that confers a particular status or benefit upon a player who achieves it on a bingo ticket provided for that player. For example, an intermediate pattern may be defined to be all of the symbols in one or more rows, columns, or diagonals on a bingo ticket being marked. More complex intermediate patterns may be defined, however, such as all of the grid positions in a square, rectangle, or diamond shape being marked. Intermediate patterns may be arbitrarily defined based on the grid configuration on one or more tickets, or based on some other means. Like match-ending patterns, grid positions indicated as "free" may be considered to be marked for purposes of determining when an intermediate pattern is achieved.

Preferably, the first player to achieve an intermediate pattern is awarded the status or benefit associated with the intermediate pattern. It is possible for more than one player to achieve the intermediate pattern on the same iteration of the bingo match. In this case, all of the players achieving the intermediate pattern may be awarded or may share the status or benefit. Furthermore, the intermediate pattern may be associated with different statuses or benefits for each player than achieves the intermediate pattern. For example, the first player to achieve an intermediate pattern may be awarded one status or benefit, while players to achieve the intermediate pattern on subsequent iterations of the networked bingo match may be awarded different statuses or benefits.

For variations of networked bingo that use a strip of tickets, match-ending patterns and intermediate patterns may need only appear on one or more of the strips, rather than across the entire ticket. For example, a match-ending pattern may be defined to be particular pattern that appears on any strip, and the first player to exhibit that pattern on at least one of his or her strips is determined to be the winner of the match.

V. Prizes

Match-ending patterns, intermediate patterns, or other events in a networked bingo game may be associated with prizes. The prizes may be monetary or may have some other value. Examples of non-monetary prizes include goods or services, options to buy goods or services, chances in a raffle, an opportunity to meet a celebrity or particular person or persons, or any other valuable good, commodity, service, or benefit.

Prizes may also be progressive in nature. A progressive prize is typically a prize that is not necessarily awarded in each bingo match, but increases in value for each bingo match played. For example, a progressive prize of monetary value may begin at a certain minimum level, say 100 dollars. For each bingo match played for which the progressive prize is not awarded, the progressive prize may increase in value by a fixed amount, by a percentage of the cost of entry to the match paid by each player, or according to some other formula. Thus, the more bingo matches played, the larger the progressive prize, the more attractive the game is to players, and the higher the potential revenue for the networked bingo match operator.

VI. Variations

It will be appreciated that the embodiments for playing networked bingo described above include virtually limitless variations of bingo matches and game play. Thus, virtually unlimited example embodiments of bingo can be defined. In one example embodiment described herein, each player wishing to participate in the bingo match may be required to purchase at least one bingo ticket including one bingo strip. A player may, of course, purchase multiple bingo tickets for the bingo match.

VII. Example Networked Bingo Architecture

Figure 1:
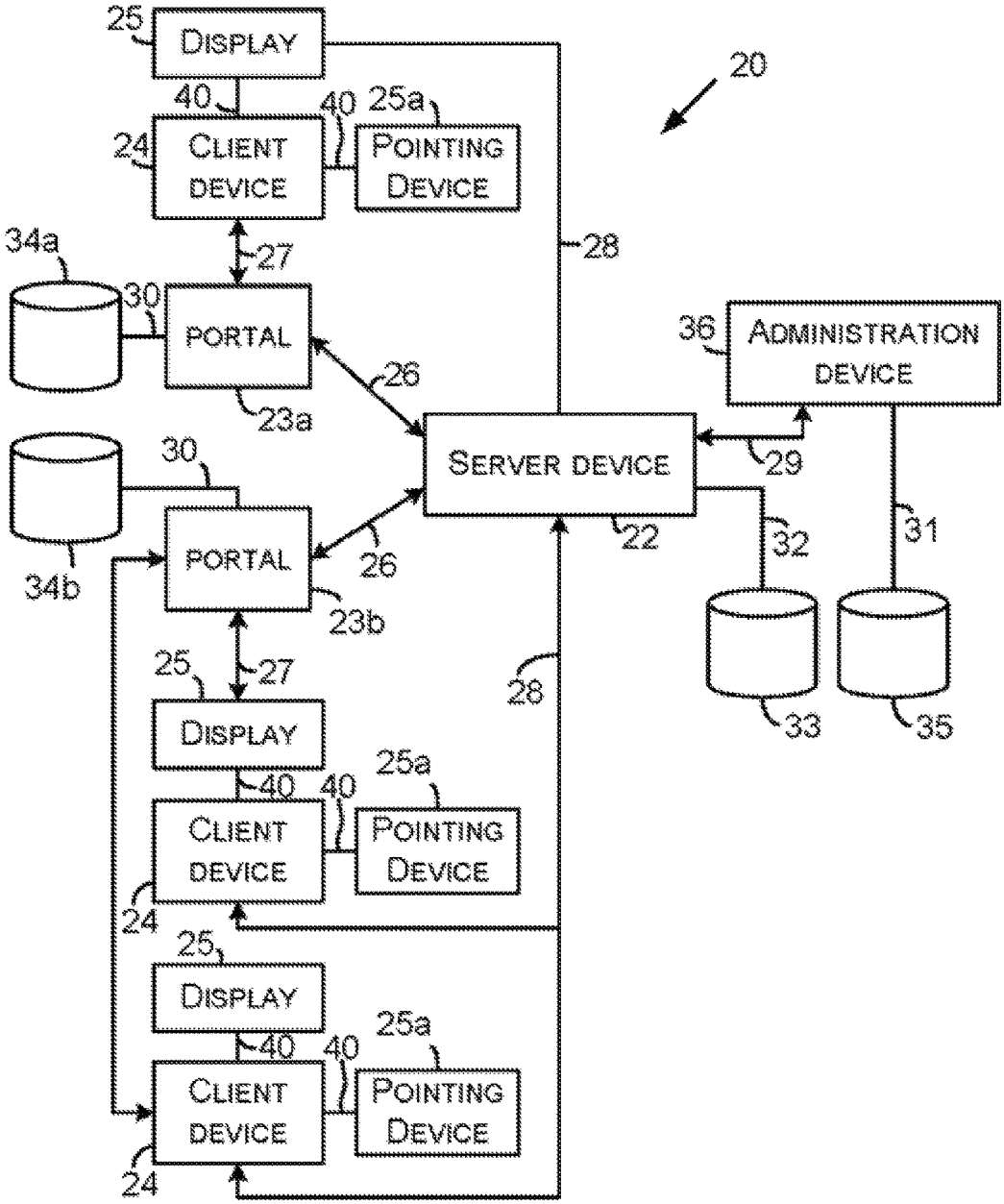
FIG. 1 is a simple block diagram of a networked bingo client/server architecture in accordance with example embodiments.

Networked bingo may be facilitated through the interconnection of computers and computer networks arranged to facilitate such game play. FIG. 1 depicts an example of such an arrangement. It should be understood, however, that this and other arrangements and processes described herein are set forth for purposes of example only, and other arrangements and elements (e.g., machines, interfaces, operations, orders of elements, etc.) can be added or used instead, and some elements may be omitted altogether. Further, as in most communication architectures, those skilled in the art will appreciate that many of the elements described herein are functional entities that may be implemented as discrete components or in conjunction with other components, in any suitable combination and location.

In FIG. 1, system 20 includes a server device 22, a number of databases 33, 34*a*, 34*b*, 35, an administration device 36, and a number of portals 23*a*, 23*b*, preferably in the form of World Wide Web (WWW) sites. In this embodiment, each of the portals 23*a*, 23*b* may include an online bingo room hosted on a corresponding bingo web server (not shown). Furthermore, each of the portals 23*a*, 23*b* may be accessible by a would-be bingo player (not shown) using a client device 24 having a display 25 and an associated pointing device 25*a*, such as a mouse or, alternatively, a touchpad.

In this embodiment, the online bingo portal 23*a* is shown as having one client device 24 logically connected thereto, whereas bingo portal 23*b* is shown as being logically connected to two client devices 24. It will be appreciated by those skilled in the art that such an online bingo portal 23*a*, 23*b* can be logically connected to any number of such client devices 24 simultaneously.

Server device 22, databases 33, 34*a*, 34*b*, 35, bingo portal web servers (not shown) corresponding to the bingo portal 23*a*, 23*b*, client devices 24 and administration device 36 are capable of communicating with each other by means of communication networks 26, 27, 28, 29, 30, 31 and 32. Communication networks 26, 27, 28, 29, 30, 31 and 32 may be public Internet Protocol (IP) networks such as the Internet, or private IP networks, or public or private networks that operate according to other communication protocols. Furthermore, communication networks 26, 27, 28, 29, 30, 31 and 32 may be purpose-built or hardcoded networks designed for the support of networked bingo. For example, server device 22 may be a mainframe computer and client devices 24 may be so-called "dumb terminals" that only communicate with server device 22. Thus, communication networks 26, 27, 28, 29, 30, 31 and 32 may only include communication links between the devices they connect.

Client devices 24, server device 22, databases 33, 34*a*, 34*b*, 35, and administration device 36 may include various computing technologies, such as those that are semiconductor-based, magnetic, optical, acoustic, or biological in nature, any combination of these computing technologies, or any other technology known today or developed in the future, that can be used in conjunction with computational devices. The devices shown in FIG. 1 can be configured to generate, provide, receive, store, or display enhanced bingo strips for networked bingo matches.

A networked bingo architecture may also be defined to include more or fewer elements. For example, server device 22 and database 33 may be combined into the same physical or logical device, or each distributed across more than one physical or logical device. Two or more other devices of system 20 can be combined as well.

A. Example Server Device

Server device 22 may include a computing device with input, output, processing, storage, and memory operations. Server device 22 may be a form of personal computer, or may be physically designed for server operation. For example, server device 22 may be a rack-mounted or blade server component.

Server device 22 preferably includes at least one computer-readable processor (or more simply "processor"), one or more banks of memory, and computer-readable program instructions stored in the memory and executable by the processor to carry out operations described herein. The computer-readable program instructions may be more simply be referred to as "program instructions," "software instructions," "computer instructions," or "program." Server device 22 can include a user interface to perform at least some of the input and output operations.

For purposes of this description, a processor, such as a processor in server device 22, can comprise one or more general purpose processors (e.g., INTEL® single core microprocessors or INTEL® multicore microprocessors) or one or more special purpose processors (e.g., digital signal processors). A processor can be configured to execute program instructions stored in a memory. For purposes of this description, a bank of memory or a memory, such as a memory of server device 22, can comprise a non-transitory computer-readable storage medium readable by a processor. Each non-transitory computer-readable storage medium can comprise volatile and/or non-volatile storage components, such as optical, magnetic, organic or other memory or disc storage, which can be integrated in whole or in part with a processor. A bank of memory or a memory can be referred to as a "data storage device" or more simply, "data storage."

With respect to the depiction of server device 22 in FIG. 1, server device 22 may actually take the form of multiple physical components or computers that are co-located or distributed. For example, server device 22 may be a cluster of computing devices that operate in conjunction with one another to enable networked bingo matches. This cluster may be in a particular physical location, such as an Internet service provider (ISP), or may operate over a network to coordinate server operations.

Server device 22 may run a standalone or distributed operating system to enable server operations. This operating system may be based on Microsoft Windows®, Apple's MacOS®, Linux®, FreeBSD® or various other technologies. These operating systems preferably support multiple processes or threads of execution so that a single server device 22 can support a potentially large number of networked bingo matches simultaneously (e.g., tens, hundreds, or thousands of matches).

Server device 22 preferably operates under control of a server-stored program (not shown) capable of enabling multiple players (e.g., all players) accessing a bingo portal 23*a*, 23*b* by a client device 24 to participate in one or more games of networked bingo. The server-stored program provides a discrimination capability in the form of computer instructions configured to be executed by a processor to determine a winner or winners of a networked bingo match. The stored program in server device 22 (e.g., in a memory of server device 22) may also maintain a dynamic register of all players admitted to, and actively participating in, a networked bingo match, together with data representative of a corresponding bingo portal 23*a*, 23*b* through which each participating player may access a networked bingo game.

Server device 22 can also include a communication interface that provides for transmitting communications to or over a communication network and that provides for receiving communications from or over a communication network. A network connection, provided by the communication interface, can take the form of a wireline connection, such as an Ethernet, cable modem, digital subscriber line, or T1 carrier connection. Additionally or alternatively, the network connection can take the form of a local area or wide area wireless connection, such as IEEE 802.11 (Wifi), Code Division Multiple Access (CDMA), Global System for Mobile communications (GSM®), Long-Term Evolution (LTE), or Worldwide Interoperability for Microwave Access (WIMAX®). However, other forms of physical layer connections and other types of standard or proprietary communication protocols may be used.

Server device 22 can include a system bus, network, or other connection mechanism that connects or otherwise links two or more of the processor, the memory, and the user interface and the communication interface that make up a least a portion of server device 22.

B. Example Database

Database 33 is preferably coupled to server device 22, and stores networked bingo game information. Database 33 is either a standalone component, as shown in FIG. 1, or it may be combined with server device 22. Database 33 may contain profile data for players of a networked bingo match. This profile data may include a player's identification and protocols, techniques, and/or data for authenticating and authorizing the player, such as a username and password. The profile data may also include information pertinent to a networked bingo match, such as any bingo tickets or strips associated with the player. The profile data may additionally include other information that an operator of a networked bingo game might find useful to store, such as the player's method of payment (e.g., credit card information or bank account information), win/loss record, historical wagering data, a "friends list" of other players, and so on.

Database 35 is preferably coupled to administrative device 36. Database 34*a* is preferably coupled to portal 23*a*. Database 34*b* is preferably coupled to portal 23*b*. Databases 34*a*, 34*b*, and 35 can be standalone components, as shown in FIG. 1, or can be combined with portal 23*a*, portal 23*b*, administrative device 36, respectively. Database 35 can store data pertaining to server device 22 or one or more other server devices (not shown) in system 20. Databases 34*a*, 34*b* can store data pertaining to portals 23*a*, 23*b*, respectively.

Databases 33, 34*a*, 34*b*, 35 may be facilitated by database software, such as that from Oracle® Corporation, MySQL® AB, or the PostgreSQL free software. Furthermore, databases 33, 34*a*, 34*b*, 35 may operate across multiple physical devices in a clustered mode. However, databases 33, 34*a*, 34*b*, 35 need not be a database in the traditional sense, and may instead include one or more flat text files, or some other means of storing and retrieving profile data.

C. Example Client Devices

Client devices 24 may include a personal computer, laptop computer, a wireless communication device such as a cell phone, a personal digital assistant, a computer terminal, or a similar device. Client devices 24 each preferably include at least one processor, one or more banks of memory, and program instructions stored in the memory and executable by the processor to carry out operations described herein. Furthermore, client devices 24 may operate under an operating system such as Microsoft Windows®, Apple MacOS®, Linux®, or FreeBSD®, and are preferably provisioned with a web browser and network connection. Client devices 24 can each include a user interface having a display 24 and a pointing device 25*a*.

Client devices 24 can include a communication interface that provides for transmitting communications to or over a communication network and that provides for receiving communications from or over a communication network. A network connection, provided by the communication interface, can take the form of a wireline connection, such as an Ethernet, cable modem, digital subscriber line, or T1 carrier connection. Additionally or alternatively, the network connection can take the form of a local area or wide area wireless connection, such as IEEE 802.11 (Wifi), CDMA, GSM, or WIMAX. However, other forms of physical layer connections and other types of standard or proprietary communication protocols may be used.

Client devices 24 can each include a system bus, network, or other connection mechanism 40 that connects or otherwise links two or more of the processor, the memory, the user interface and the communication interface that make up at least a portion of each client device 24.

Using a client device 24, networked bingo may be facilitated by a client process (not shown) that executes on client device 24, and the server-stored program (not shown), or server process, that executes on server device 22. In order to play a networked bingo match from any client device 24, a client process (not shown) may first be downloaded, for example, from server device 22 or bingo portal 23*a*, 23*b* to client device 24. The downloaded client process (not shown) may then be installed in client device 24, where after it is ready for execution. Alternatively, the client process (not shown) executes from within a WWW browser of client device 24, and is loaded from the player's bingo portal 23*a*, 23*b* WWW server (not shown) by the client device's 24 WWW browser. In either case, once the client process (not shown) is launched, communication between client device 24 and server device 22 then proceeds.

In a distributed topology, the client process (not shown) on the player's client device 24 may be functionally identical, irrespective of which online bingo portal 23*a*, 23*b* a player selects to access a networked bingo match. The output operations of client device 24 may include a graphical user interface (GUI) rendered on display 25. Such a GUI may represent networked bingo match information in some combination of graphics and text. For example, a GUI on display 25 may represent a bingo ticket associated with client device 24, and include options to perform the acts of providing a form of payment, purchasing a bingo strip, and/or cashing out a balance of funds or a prize. The client process executing on client device 24 may display different trademarks, color schemes, or "look and feel" depending on which online bingo portal 23*a*, 23*b* was selected by the player.

D. Example Administration Facilities

System 20 further includes administration device 36, preferably in the form of an application server coupled to server device 22 using communication network 29. Administration device 36 may be used by operators of networked bingo games to monitor the status of client devices 24, server device 22, and database 33. Additionally, operators of networked bingo games may use an administration device to monitor, collect, or repair the status of players or matches. For example, an administration device may allow an operator to view the number of players in a networked bingo match, the amount of money being wagered in the match, size of a progressive prize, and so on. Additionally, administration device 36 preferably settles the wagers of the participating players after the completion of each iteration of a networked bingo match. Administrative device 36 can include a processor, a memory, a user interface, and a communication interface, all of which can be linked together via a system bus, network, or other connection mechanism.

E. Example Networked Bingo Operators

Operators of networked bingo matches are not shown in FIG. 1. These operators may be individuals, groups, corporations, or other business or non-business entities that operate networked bingo games for entertainment, profit or other purposes. Multiple operators may operate networked bingo games on the same physical devices, or may own or have dedicated access to certain devices. Furthermore, devices operated by different operators may be networked to allow distributed networked bingo matches, thus expanding the reach of an operator to include players that may not have a business relationship with the operator.

VIII. Example Networked Bingo Match Play

Using client device 24, a networked bingo match may be facilitated by a client process (not shown) that executes on client device 24, and the server-stored program (not shown), or server process, that executes on server device 22. The server process (not shown) may generate one or more random events representing a "called" symbol. The client process obtains the result of each random event from server device 22, across the communication network 28, and marks any grid position on a player's bingo tickets or strips that is associated with the same symbol as that of the "called" symbol. The client process displays a representation the player's bingo ticket or strips on the display 25 of client device 24 with any marked off grid positions being discernible on the bingo tickets. A single client device 24 (executing the client process) may be used by more than one human player. A human player may use more than one client device 24.

Each of the methods described herein are for purposes of example. In each method, more or fewer operations may be used, and the operations may be carried out in a different order than is illustrated in the figures or described herein.

A. Example Registration and Payment

An operator of networked bingo matches may require a client device 24 to register and/or provide payment for networked bingo match services prior to allowing client device 24 to participate in these networked bingo match services.

Figure 2:
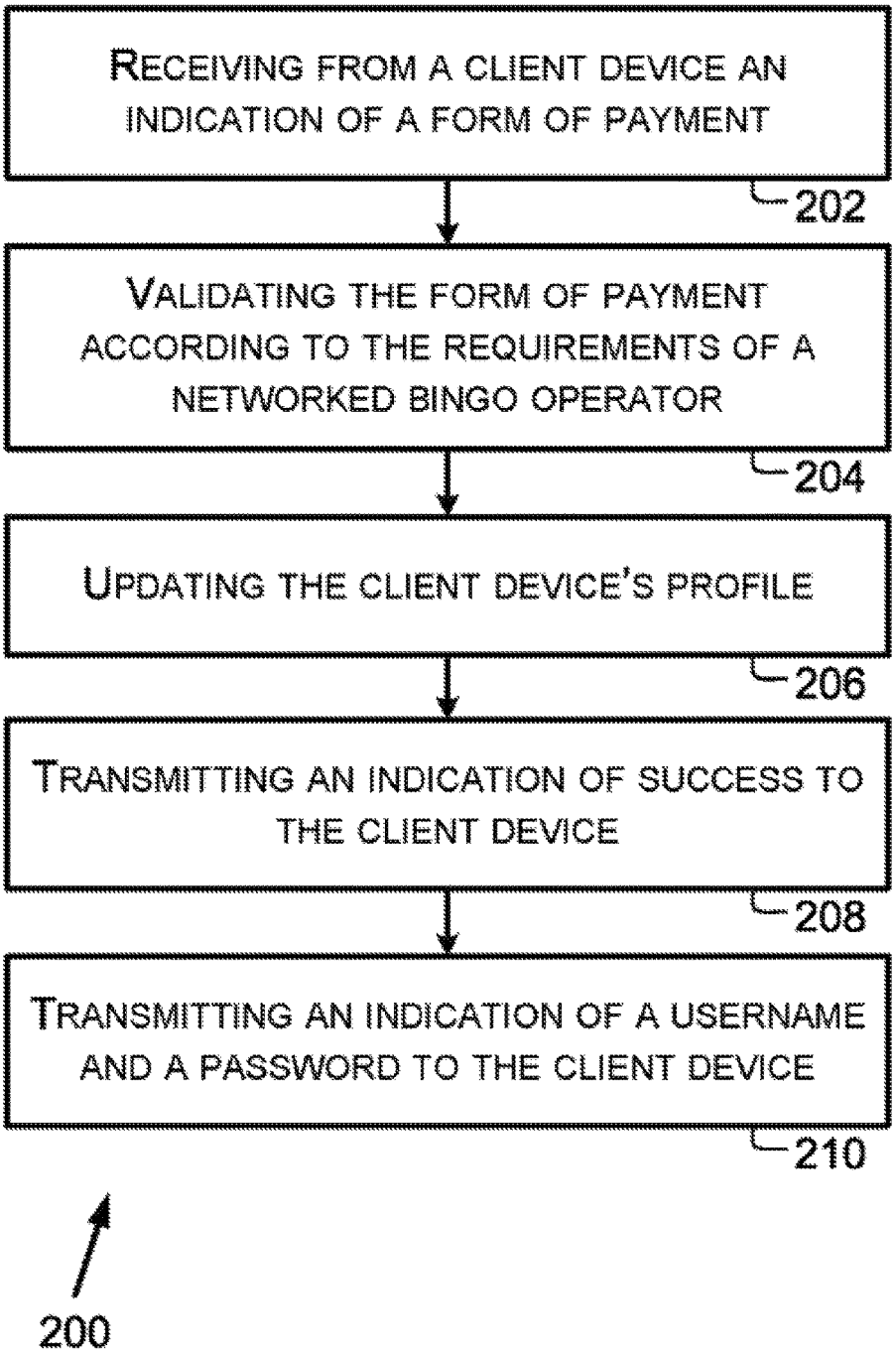
FIG. 2 is a flow chart depicting a set of operations pertaining to processing registrations and payments for networked bingo in accordance with example embodiments.

FIG. 2 is a flowchart depicting a set of operations 200 (or more simply "the set 200") that can be carried out in accordance with one or more example embodiments described herein. The set 200 includes the operations shown in blocks labeled with even numbers 202 through 210, inclusive. A variety of methods can be performed using one or more of the operations shown in set 200 and one or more other operations described herein. The set 200 depicts an example registration and payment process that can be carried out using server device 22 and client device 24.

Block 202 includes receiving, by server device 22 from client device 24, an indication of a form of payment. Acceptable forms of payment can include, but are not limited to, a credit card, a debit card, or bank account information, as well as other methods of facilitating traditional or electronic payments. Next, block 204 includes validating, by server device 22, the form of payment according to the requirements of an operator of networked bingo. This validation may include transactions between server device 22, database 33, and third-party payment verification services that are not represented in FIG. 1.

Assuming that the form of payment is properly validated, block 206 includes updating, by server device 22, the profile of client device 24 in the database 33. This update may include adding a representation of the form of payment to the profile of client device 24 in the database 33, updating the amount or type of funds available to client device 24, or other actions. Next, block 208 includes transmitting, by server device 22, an indication of success to client device 24. Client device 24 may responsively display an indication of success on an output peripheral, such as display 25.

Next, block 210 includes transmitting an indication of a username and password to client device 24. This transmission can occur by server device 22 and over a communication network. This transmission operation would preferably occur when a new networked bingo account is being provisioned on behalf of client device 24. Client device 24 may then, and as needed, use the username and password to log on to server device 22 and participate in networked bingo.

B. Example Bingo Strip Generation and Distribution

Preferably, server device 22 generates and distributes bingo strips for networked bingo matches. As described herein, these bingo strips may be computerized (e.g., computer-readable) representations of bingo strips that are generated and stored for later use, or may be generated in real time, as needed. Thus, the generation of bingo strips at server device 22 may be triggered by one or more networked bingo match events or may occur asynchronously to client device 24 and match activities. For example, client device 24 may request a bingo strip and server device 22 may dynamically generate a new bingo strip in response to the request, or server device 22 may, from time to time, generate a number of new bingo strips and then store these bingo strips in a memory for later use.

Figure 5:
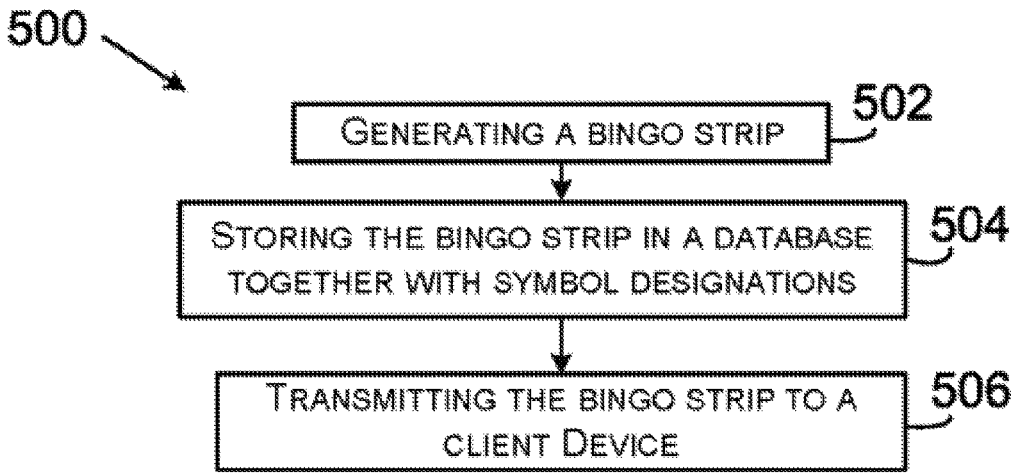
FIG. 5 is a flow chart depicting a set of operations pertaining to generating bingo strips in accordance with example embodiments.

FIG. 5 is a flowchart depicting a set of operations 500 (or more simply "the set 500") that can be carried out in accordance with one or more example embodiments described herein. The set 500 includes the operations shown in blocks labeled with even numbers 502 through 506, inclusive. A variety of methods can be performed using one or more of the operations shown in set 500 and one or more other operations described herein. The set 500 depicts an example process generating and distributing bingo strips using server device 22 and other elements of system 20. The bingo strip can include a computer-readable bingo strip.

Block 502 includes generating, by server device 22, a bingo strip (e.g., one or more bingo strips). Generating the bingo strip can include selecting a quantity of symbols from symbol set 416 for the bingo strip. As an example, the quantity of selected symbols could equal 15 symbols or another quantity of symbols, and the remaining symbols on the bingo strip can be free space symbols. Server device 22 can use a random number generator to select the symbols. Generating the bingo strip can include selecting a grid position for each symbol of the selected symbols and a grid position for each free space symbol. Table 1 includes example symbols selected from symbol set 416 for a bingo strip with 27 grid positions, such as bingo ticket 302. "FS" represents a free space symbol.

TABLE 1

| | | | | | | | | |
|---|---|---|---|---|---|---|---|---|
| FS | 45 | FS | 6 | 77 | FS | 38 | 4 | FS |
| FS | 18 | FS | FS | 15 | 82 | 55 | FS | 57 |
| 1 | FS | FS | 69 | FS | 44 | 16 | 88 | FS |

Generating the bingo strip can include storing a symbol identifier for the selected symbol and an associated grid position identifier. The data stored for the generating bingo ticket 302 can be configured in various configurations. As an example, the stored data can be stored in a configuration of (symbol identifier, grid position). In that case, for bingo ticket 302, the stored data can be configured as: (FS, 1), (45, 2), (FS, 3), (6, 4), (77, 5), (FS, 6), (38, 7), (4, 8), (FS, 9), (FS, 10), (18, 11), (FS, 12), (FS, 13), (15, 14), (82, 15), (55, 16), (FS, 17), (57, 18), (1, 19), (FS, 20), (FS, 21), (69, 22), (FS, 23), (44, 24), (16, 25), (88, 26), (FS, 27). Other examples configurations for storing data representing the selected symbol and an associated grid position are also possible.

Next, block 504 includes storing the bingo strip in a database (e.g., database 33 or other memory). Storing the bingo strip and the symbols selected for the bingo strip including any extra symbols can include storing a symbol designation or identifier for the selected symbols. If the bingo strip is associated with a client device 24, the database or other memory can store the bingo strip in a profile that is associated with client device 24. If the bingo strip is not associated with a client device, the database or other memory can store the bingo strip for future retrieval and associating with a client device.

Next, block 506 includes transmitting, by server device 22, the bingo strip to a client device 24. The communication interface of server device 22 can transmit the bingo strip onto the communication network for transmission, in turn, to the client device.

Although the set 500 is described with respect to server device 22 generating and distributing bingo strips, another component such as portal 23*a* or 23*b* or administration device 36 can be configured to perform the set 500 or any operation thereof.

Any changes to a bingo strip or bingo ticket as a result of performing any operation of the set 500 can cause server device 22 to modify the bingo strip or ticket stored in the memory, such as database 33, and to transmit, to the client device 24 displaying the bingo strip or bingo ticket, data to modify the data stored at the client device for displaying the iterations of the networked bingo match.

C. Example Iterations of a Networked Bingo Match

An iteration of a networked bingo match includes a new symbol being "called" (i.e., selected) and each bingo ticket or bingo strip competing in the networked bingo match being checked to determine if the bingo tickets or bingo strips contain the new symbol. For a bingo strip that contains the new symbol, server device 22 may perform additional sets of determinations and steps. These steps may include altering the status of the client device 24 based on the new symbol.

Figure 6A:
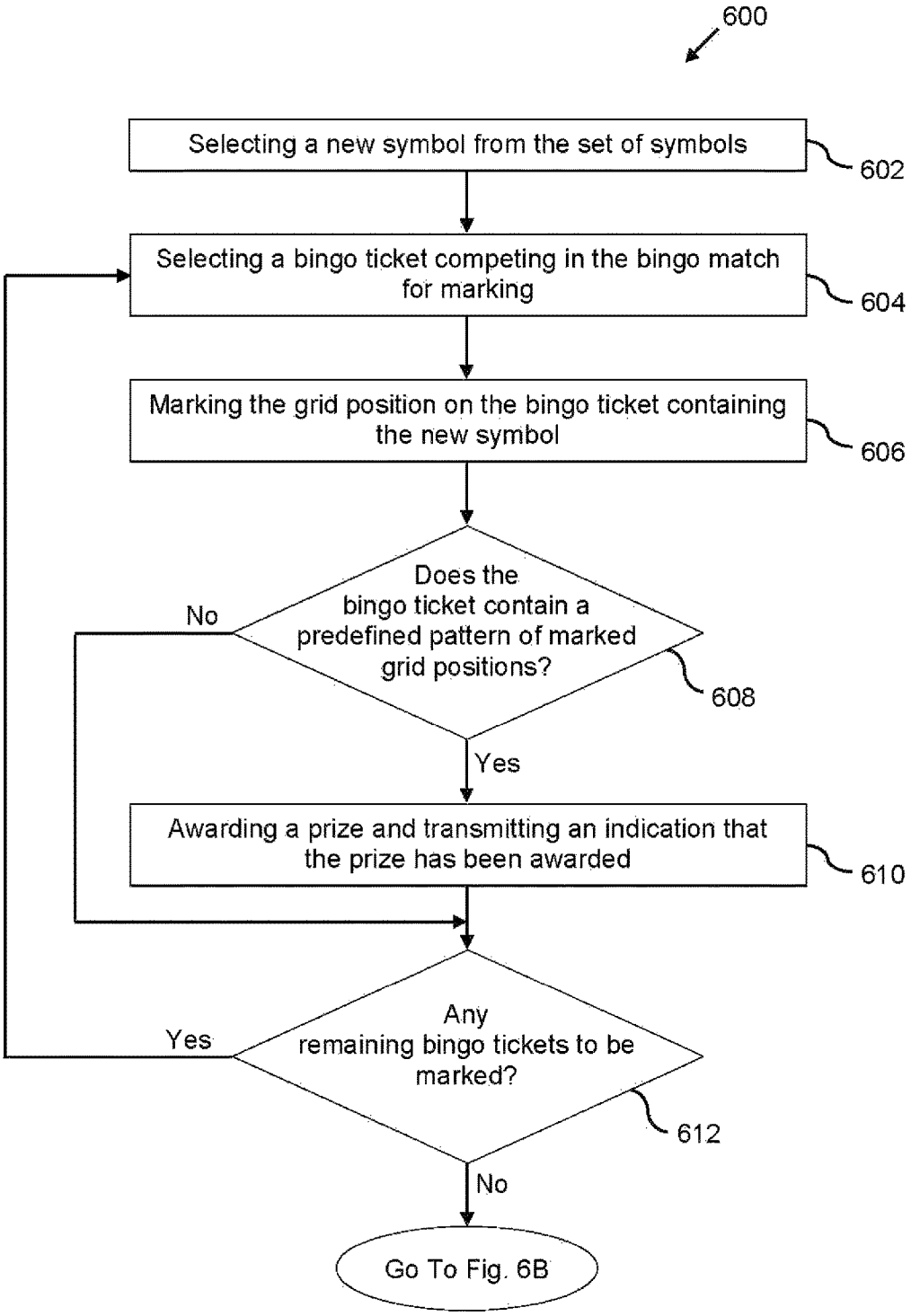
FIG. 6A is a flow chart depicting a set of operations pertaining to performing an iteration of networked bingo in accordance with example embodiments.
Figure 6B:
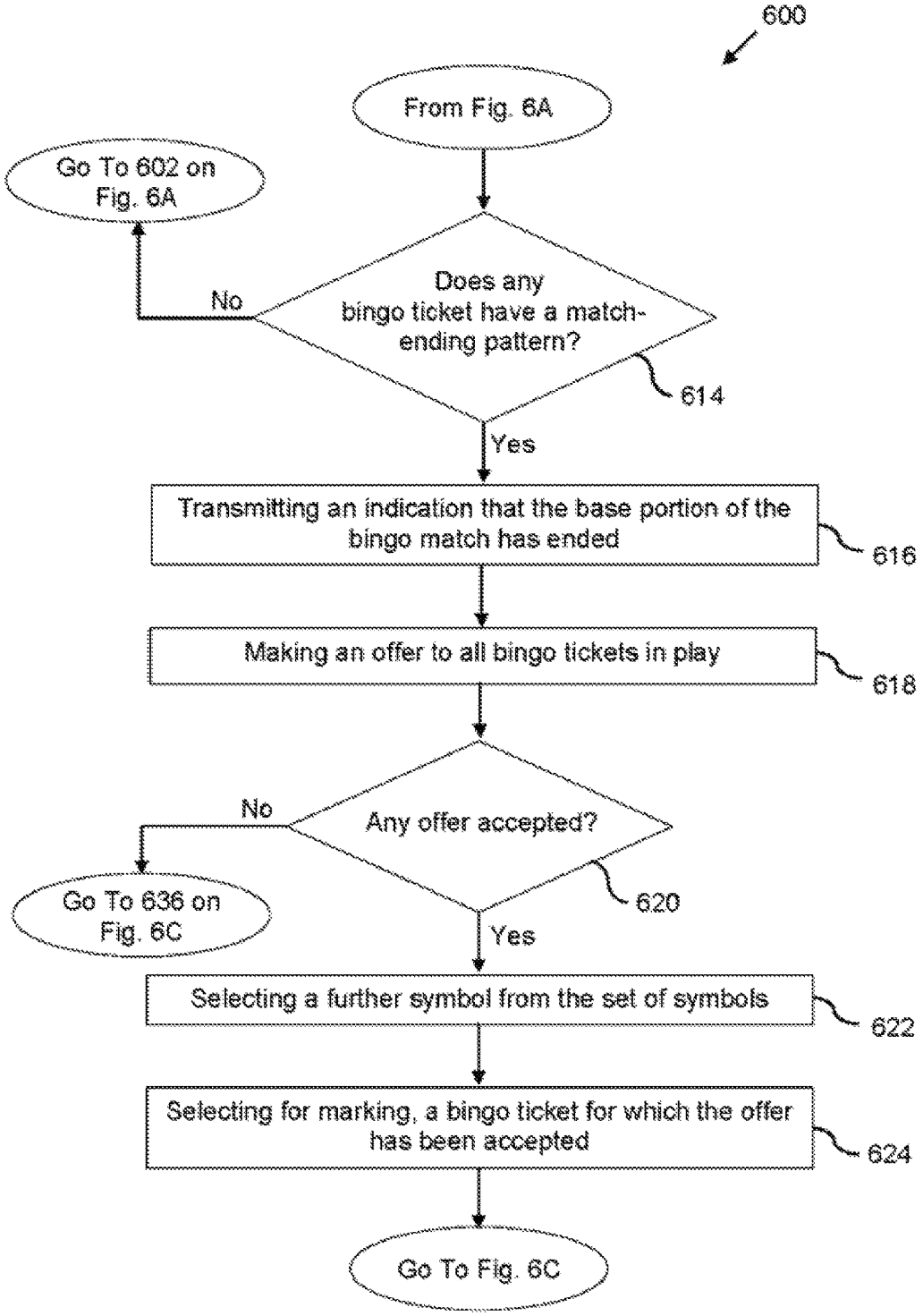
FIG. 6B is a flow chart depicting a set of operations pertaining to performing an iteration of networked bingo in accordance with example embodiments.
Figure 6C:
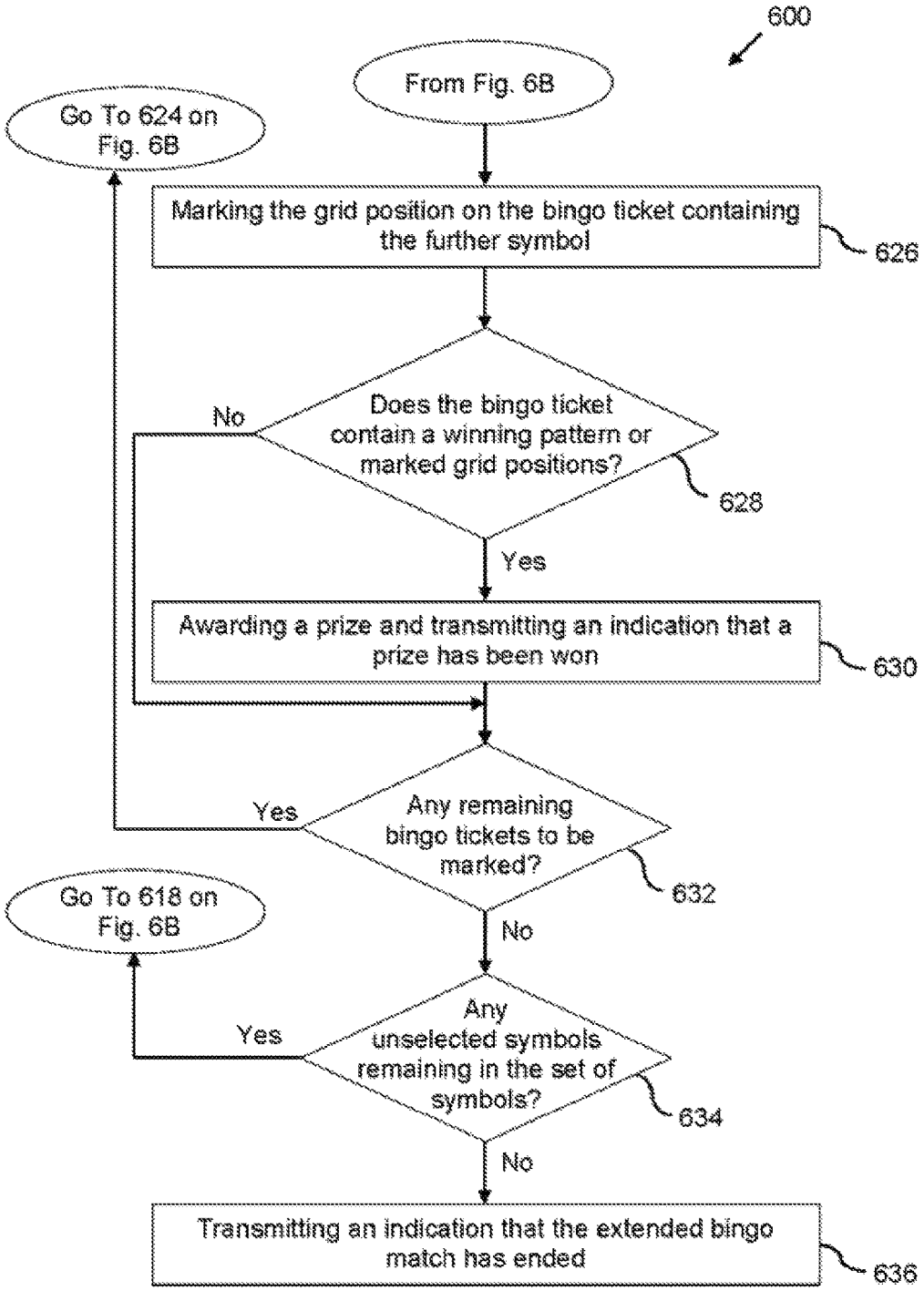
FIG. 6C is a flow chart depicting a set of operations pertaining to performing an iteration of networked bingo in accordance with example embodiments.

Next, FIG. 6A, FIG. 6B, and FIG. 6C are flowcharts depicting a set of operations 600 (or more simply "the set 600") that can be carried out in accordance with one or more example embodiments described herein. The set 600 includes the operations shown in blocks labeled with even numbers 602 through 636, inclusive. The set 600 depicts an example process pertaining to performing an iteration as part of a networked bingo match. The devices described in this section as performing any part of an operation of the set 600 can do so, at least in part, by a processor of that device executing software program instructions.

Turning to FIG. 6A, block 602 includes selecting, by server device 22, a new symbol from the set of symbols 402. Selecting the new symbol may be performed with or without replacement. Server device 22 can use a random selection process to select the new symbol.

Next, block 604 includes selecting, by server device 22, a bingo ticket competing in the networked bingo match for marking. As an example, if 30 players have been provided with a respective bingo ticket for the bingo match, selecting the bingo ticket can include selecting the bingo ticket provided to a first player. Upon returning to block 604 from block 612 (discussed below), server device 22 can select the bingo ticket of another one of the 30 players ticket for marking. Server device 22 is not limited to marking a single bingo ticket at any one time, but can be configured to mark multiple competing bingo tickets simultaneously. Selecting a bingo ticket can include transmitting a representation of the bingo ticket from a memory, such as database 33, to a processor within server device 22. Selecting a bingo ticket can also include server device 22 determining that the bingo ticket has not already been marked for a current iteration of the bingo match.

Next, block 606 includes marking, by server device 22, the grid position on the bingo ticket containing the symbol to be marked. Marking the grid position can include marking the symbol or symbols within the grid position. Marking the grid position can include modifying the bingo ticket or bingo strip stored in a memory, such as database 33, to include an indicator or other data that the grid position or symbol(s) therein is marked. The data in Table 2 below show an example of grid positions or symbols marked with an indicator "Y" to indicate the grid position or symbols therein are marked.

TABLE 2

| | | | | | | | | |
|---|---|---|---|---|---|---|---|---|
| FS/Y | 45/Z | FS/Y | 6/Z | 77/Z | FS/Y | 38/Z | 4/Z | FS/Y |
| FS/Y | 18/Z | FS/Y | FS/Y | 15/Z | 82/Z | 55/Y | FS/Y | 57/Z |
| 1/Y | FS/Y | FS/Y | 69/Z | FS/Y | 44/Z | 16/Y | 88/Z | FS/Y |

As an example, the data representing the bingo strip can be stored in a configuration of (symbol identifier, grid position, and marked status (Y for marked and Z for unmarked)). In that case, if symbols 1, 16, and 55 and free spaces are selected to be marked or are already marked for bingo ticket 302 and the remaining symbols are unmarked, the stored data can be configured as: (FS, 1, Y), (45, 2, Z), (FS, 3, Y), (6, 4, Z), (77, 5, Z), (FS, 6, Y), (38, 7, Z), (4, 8, Z), (FS, 9, Y), (FS, 10, Y), (18, 11, Z), (FS, 12, Y), (FS, 13, Y), (15, 14, Z), (82, 15, Z), (55, 16, Y), (FS, 17, Y), (57, 18, Z), (1, 19, Y), (FS, 20, Y), (FS, 21, Y), (69, 22, Z), (FS, 23, Y), (44, 24, Z), (16, 25, Y), (88, 26, Z), (FS, 27, Y). Other example configurations for storing data representing the selected symbol, an associated grid position, and/or extra symbols are also possible.

Next, block 608 includes determining, by server device 22, whether the bingo ticket (or bingo strip) contains a predefined pattern of marked grid positions. Preferably, the marked grid positions on the bingo strip include the grid position containing the new symbol. The pre-defined pattern may be a match-ending pattern or an intermediate pattern. If server device 22 determines the bingo ticket does not contain a predefined pattern of marked grid positions at block 608, the set 600 can continue at block 612. If server device 22 determines the bingo ticket does contain a pre-defined pattern of marked grid positions, the set 600 can continue at block 610.

Next, block 610 includes awarding, by server device 22, a prize and transmitting an indication that the prize has been awarded. If the bingo ticket contains a pre-defined pattern, then, at block 610, server device 22 may award at least some of a prize to the player at client device 24 displaying the bingo ticket and transmit an indication to client device 24 that it has been awarded at least some of the prize. Client device 24 might not be awarded the entire prize because the networked bingo match rules may specify that if two or more client devices 24 qualify to win the same prize on the same iteration of the bingo match, these players or client devices share the prize. The communication device of server device 22 can transmit the indication to the client device displaying the bingo ticket selected at block 604 over a communication network.

Next, block 612 includes determining, by server device 22, whether any remaining bingo tickets (or bingo strips) are to be marked. If at least one more bingo ticket remains to be marked in response to selection of the new symbol, the set 600 can continue at block 604, otherwise the set 600 can continue at block 614.

Turning to FIG. 6B, block 614 includes determining, by server device 22, whether any bingo ticket or bingo strip has a match-ending pattern. If server device 22 determines that none of the competing bingo tickets or bingo strips includes the match-ending pattern, then the set 600 continues at block 602, otherwise the set 600 continues at block 616.

Next, block 616 includes transmitting, by server device 22 to the client devices 24 competing in the networked bingo match, an indication the base portion of the networked bingo match has ended.

Any changes to a bingo strip or bingo ticket as a result of performing any operation of the set 600 can cause server device 22 to modify the bingo strip or ticket stored in the memory, such as database 33. Server device 22 may also transmit, to the client device 24 displaying the bingo strip or bingo ticket, data to modify the data stored at the client device for displaying the iterations of the networked bingo match.

Next, the server device 22 may extend the networked bingo match by making, at block 618, an offer to all of the bingo tickets other than the bingo ticket(s) with the match-ending pattern (or, collectively and more simply, "the bingo tickets in play"). The offer consists of a selection of a further symbol from the set of symbols. The offer to any particular bingo ticket in play is made to the client device displaying that bingo ticket.

The offer to any particular bingo ticket in play is associated with a corresponding cost to a player at client device 24 displaying that bingo ticket. Preferably, the cost associated with the offer is proportional to the expected gain that acceptance of the offer provides to the player at that client device. The expected gain may be a function of the probability that selection of the further symbol results in a prize award, and the size of such prize award. The cost may also include a profit component (rake) for the operator of the networked bingo game.

As an example, suppose that a particular bingo ticket could, if a further symbol is selected, potentially result in any one of n possible awards being realized. Suppose further that these awards are of respective amounts $\alpha_1, \alpha_2, \ldots, \alpha_n$, and that the symbols that would result in these respective awards are selected with respective probabilities $p_1, p_2, \ldots, p_n$. Under these assumptions, the expected payout to the player with the particular bingo ticket, if that player were to accept the offer, is $$\sum_{i=1}^{n} p_i \alpha_i$$

As such, the cost to the player may be proportional to this expected payout, and a rake, r, may be added to the cost as well so that the operator of the bingo game is likely to profit by making these types of offers. Consequently, the cost, c, associated with the offer may be expressed as $$c = m\sum_{i=1}^{n} p_i \alpha_i + r$$

In this equation, m may be a multiplier that takes on a value of at least 1.0. Like the rake, the value of the multiplier may be set so that the operator of the bingo game is likely to profit by providing the offer. In some cases, the multiplier may be considered to be a form of rake.

For instance, suppose that, if a further symbol were selected, the particular bingo ticket would have a 0.05 probability of awarding the player $50 and a 0.1 probability of awarding the player $10. Thus, the expected payout to the player is (0.05)($50)+(0.1)($10)=$3.50. Assuming that m=1 and the rake set to be 10% above the expected payout, the cost to the player would be $3.85.

This particular example is just one embodiment, and other methods may be used to calculate an expected payout and the cost of an offer.

Regardless, these calculations require computer implementation. In order to make offers in real time to all of the players with bingo tickets still in play, server device 22 may need to make a large number (e.g., tens or hundreds) of cost determinations. Even with electronic assistance (e.g., the use of a pocket calculator) these operations could not be carried out fast enough by humans. For just a single bingo ticket, all possible award-winning patterns would be determined, along with the probability of each occurring. This would require knowing the distribution of symbols that remain in the supply, as well as the value of each reward. Then, the equations above would be applied to this information to determine the cost of each offer.

When taking part in a real-time networked game, such as the bingo game variations disclosed herein, players expect results of symbols being called to be displayed on their respective client machines in an expeditious fashion (e.g., in real time, such as a 1-3 seconds at most). Failure to do so may result in players becoming disinterested in the game. Consequently, the embodiments that include this simultaneous execution one or more bingo games in real time would not exist but for computer implementation thereof.

Next, block 620 includes determining, by server device 22, whether any offers to the bingo tickets in play have been accepted. If server device 22 determines that at least one offer has been accepted, the set 600 can continue at block 622, otherwise the set 600 can continue at block 636.

Next, block 622 includes selecting, by server device 22, a further (new) symbol from the set of symbols 402. Server device 22 may use a random selection process to select the further symbol.

Next, block 624 includes selecting, by server device 22, for marking, a bingo ticket in play for which the offer to select the further symbol has been accepted. Server device 22 is not limited to marking a single bingo ticket at any one time, but can be configured to simultaneously mark multiple bingo tickets in play for which the offers to select the further symbol have been accepted. Selecting a bingo ticket can include transmitting a representation of the bingo ticket from a memory, such as database 33, to a processor within server device 22. Selecting a bingo ticket can include server device 22 determining that the bingo ticket has not already been marked for a current iteration of the extended bingo match.

Turning to FIG. 6C, block 626 includes marking, by server device 22, the grid position on the bingo ticket in play containing the further symbol to be marked. Marking the grid position can include marking the symbol or symbols within the grid position. Marking the grid position can also include modifying the bingo ticket or bingo strip stored in a memory, such as database 33, to include an indicator or other data that the grid position or symbol(s) therein is marked.

Next, block 628 includes determining, by server device 22, whether the bingo ticket (or bingo strip) contains a predefined pattern of marked grid positions. Preferably, the marked grid positions on the bingo strip include the grid position containing the further symbol. The pre-defined pattern may be any one of the intermediate patterns or the match-ending pattern of the base portion of the bingo match. If server device 22 determines the bingo ticket in play does not contain a predefined pattern of marked grid positions at block 628, the set 600 can continue at block 632. If server device 22 determines the bingo ticket does contain a pre-defined pattern of marked grid positions, the set 600 can continue at block 630.

Next, block 630 includes awarding, by server device 22, a prize and transmitting an indication that the prize has been awarded. If the bingo ticket in play contains a pre-defined pattern, then, at block 630, server device 22 may award at least some of a prize to the player at the client device 24 displaying the bingo ticket in play. Server device 22 may also transmit an indication to client device 24 that it has been awarded at least some of the prize. Client device 24 might not be awarded the entire prize because the networked bingo match rules may specify that if two or more client devices 24 qualify to win the same prize on the same iteration of the extended bingo match, these players or client devices share the prize. The communication device of server device 22 can transmit the indication to the client device 24 displaying the bingo ticket in play selected at block 604 over a communication network. Any bingo ticket in play for which a prize has been awarded is no longer in play for the next iteration of the extended bingo game.

Next, block 632 includes determining, by server device 22, whether any remaining bingo tickets in play for which the offer has been accepted, remain to be marked. If at least one more bingo ticket in play remains to be marked in response to selection of the further symbol, the set 600 can continue at block 634, otherwise the set 600 can continue at block 634.

Next, block 634 includes determining, by server device 22, whether there are any unselected symbols in the set of symbols. If the set of symbols does not contain any unselected symbols, the set 600 can continue at block 636, otherwise the set 600 can continue at block 618.

Next, block 636 includes transmitting, by server device 22 to the client devices competing in the extended networked bingo game, an indication that the extended bingo game has ended.

Figure 7:
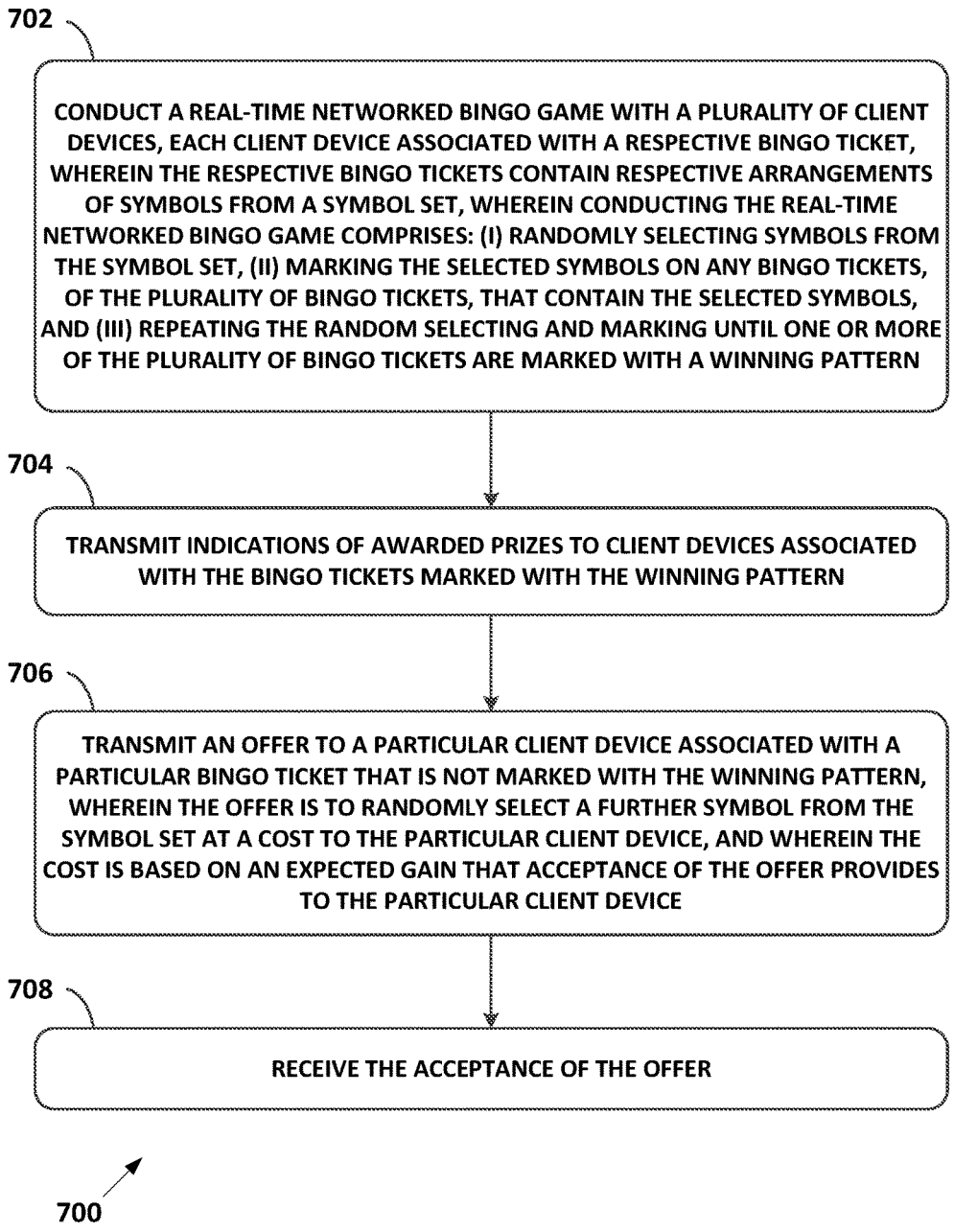
FIG. 7 is a flow chart depicting a set of operations in accordance with example embodiments.

FIG. 7 depicts a flow chart showing a set of operations 700 (or more simply, "the set 700") that can, for example, be carried out using server device 22 and/or client device 24. To the extent that a client device carries out any of the set 700, these operations may also include displaying various types of information, such as bingo tickets, symbol sets, prizes and prize amounts, and so on. While this disclosure includes examples in which the a server device performs select operations and sends data to a client device, such that the client device may perform complementing operations and receive the data, variations may to those operations may be made while adhering to the general server-client dichotomy and the scope of the disclosed devices and methods. Indeed, the "break point" between the server device operations and the client device operations may be varied.

Note that several of the operations described in connection with FIG. 7 parallel operations described in connection with FIGS. 6A-6C. As such, variations of the operations described in connection with FIGS. 6A-6C are likewise applicable to the operations described in connection with FIG. 7.

Block 702 includes conducting a real-time networked bingo game with a plurality of client devices, each client device associated with a respective bingo ticket. The respective bingo tickets may contain respective arrangements of symbols from a symbol set. Conducting the real-time networked bingo game may involve: (i) randomly selecting symbols from the symbol set, (ii) marking the selected symbols on any bingo tickets, of the plurality of bingo tickets, that contain the selected symbols, and (iii) repeating the random selecting and marking until one or more of the plurality of bingo tickets are marked with a winning pattern.

Next, block 704 involves transmitting indications of awarded prizes to client devices associated with the bingo tickets marked with the winning pattern.

Next, block 706 involves transmitting an offer to a particular client device associated with a particular bingo ticket that is not marked with the winning pattern. The offer may be for the server device to randomly select a further symbol from the symbol set at a cost to the particular client device. The cost may be based on an expected gain that acceptance of the offer provides to the particular client device.

Next, block 708 involves receiving the acceptance of the offer.

In some embodiments, the cost is proportional to the expected gain.

In some embodiments, the cost includes a rake amount that is provided to an operator of the bingo game.

In some embodiments, selection of the further symbol is associated with one or more possible awards for the client device, each of the one or more possible awards having a respective value and a respective probability. The expected gain may be based on a sum of products of the respective values and respective probabilities.

The embodiment of FIG. 7 may further involve, in response to receiving acceptance of the offer, randomly selecting the further symbol from the symbol set. If the further symbol is contained in the particular bingo ticket, the embodiment may also involve (i) marking the selected further symbol on the particular bingo ticket, and, in the case that the particular bingo ticket is marked with a further winning pattern, transmitting an indication of a further awarded prize to the particular client device. If the further symbol is not contained in the particular bingo ticket, the embodiment may also involve transmitting a second offer to the particular client device. The second offer may be for the server device to randomly select a second further symbol from the symbol set at a second cost to the particular client device. The second cost may be based on a second expected gain that acceptance of the second offer provides to the particular client device.

In some embodiments, transmitting the offer to the particular client device associated with the particular bingo ticket that is not marked with the winning pattern involves transmitting individual offers to all client devices associated with bingo tickets that are not marked with the winning pattern. Each offer may be associated with a respective cost to the respective client device, and each respective cost may be based on a respective expected gain that acceptance of the respective offer provides to the respective client device.

In some situations, at least 10 client devices are associated with bingo tickets that are not marked with the winning pattern, where the server device communicates with the at least 10 client devices in real time over a wide area network. However, this number of client devices can be different—for example, 5, 15, 25, 50, 100 or more client devices may be associated with bingo tickets that are not marked with the winning pattern.

In some embodiments, the individual offers are for the server device to randomly select the further symbol from the symbol set. In other embodiments, the individual offers are for the server device to randomly select different respective symbols from the symbol set for each respective client device.

In some embodiments, the particular client device is also associated with a second particular bingo ticket that is not marked with the winning pattern. Transmitting the offer to the particular client device may involve transmitting a second offer to the particular client device. The second offer may be associated with a second cost to the particular client device, and where the second cost is based on a second expected gain that acceptance of the second offer provides to the particular client device.

In some embodiments, a number of sequential offers made to the particular client device per match is limited to be no more than n, wherein n is between 1 and 5, inclusive. However, n can take on larger values. In some specific cases, n may be 1, 2, 3, or 4.

In some embodiments, the symbol set consists of 75 or 90 symbols. More or fewer symbols may be used.

In some embodiments, the winning pattern is a match-ending pattern. Alternatively, the winning pattern may be an intermediate pattern.

IX. Example Networked Bingo Matches

The following example embodiments describe two variations of networked bingo that may be enabled according to the methods, devices, and systems described herein. In order to participate in an iteration of a bingo match, a client device 24 is provided with one or more bingo tickets or bingo strips. Client device 24 may provide a payment prior to receiving the bingo tickets or strips. The payments received from the bingo tickets or strips purchased by client devices 24 are accumulated and a portion thereof, for example 20%, may be paid over to an operator of the bingo portal 23*a*, 23*b*. The remainder of the accumulated payment may form a prize that that can be won by a client device 24 competing in a bingo match.

A. 75-Symbol Networked Bingo Match

In this embodiment, the value of N for symbol sets 402 and 416 is 75 such that symbol sets 402 and 416 include 75 symbols numbered from 1 to 75, inclusive. Each bingo strip has 25 grid positions arranged in 5 rows and 5 columns. Each grid position on a bingo strip is associated, randomly, with a number between 1 and 75 corresponding to one of the 75 symbols. A bingo ticket consists of 3 bingo strips. Every symbol from 1 to 75 may appear only once in a grid position on a set. Moreover, one or more of the grid positions of one or more bingo strips on the bingo ticket can include a free space symbol instead of a symbol from symbol set 416.

The base portion of a 75-symbol bingo match can commence with server device 22 generating a random number between 1 and 75 and transmitting this random number to a client device 24. If the generated random number appears on any of the bingo strips or tickets provided to client device 24, the corresponding grid positions on the bingo strips or tickets are "marked off", for example by greying out, highlighting or marking the grid positions with an "X." Server device 22 then checks whether an intermediate pattern or a match-ending pattern has occurred on any bingo ticket of any client device 24. If none of the intermediate-patterns or the match-ending pattern occurs, server device 22 generates another random number in the same range and without replacement, and the above process repeats.

The following intermediate patterns and match-ending patterns are defined, each of which has an associated prize: intermediate pattern (or more simply "IP1"), in which a client device 24 wins 12% of the prize by being the first client device 24 to mark one complete horizontal line of grid positions on a bingo ticket, intermediate pattern (or more simply "IP2"), in which a client device 24 wins 18% of the prize by being the first client device 24 to mark two complete horizontal lines of grid positions on a bingo ticket, and a match-ending pattern, in which a client device 24 wins 70% of the prize by being the first client device 24 to successfully mark off all the grid positions on a bingo ticket in a bingo strip.

If server device 22 detects the occurrence of an intermediate pattern, a prize associated with that intermediate pattern is credited to client device 24 on whose bingo ticket the intermediate pattern occurred. The networked bingo match then continues. When server device 22 detects the occurrence of a match-ending pattern, the prize associated with the match-ending pattern is credited to client device 24 on whose bingo ticket the match-ending pattern occurred, and the base portion of the networked bingo match terminates.

If two or more client devices 24 achieve an intermediate pattern or a match-ending pattern on the same iteration of the base portion of the networked bingo match, the associated prize may be shared equally among these client devices 24.

Server device 22 then extends the bingo match by making an offer for each bingo ticket, other than the bingo ticket with the match-ending pattern (i.e., a "bingo ticket in play"), to participate in the generation of a further random number in the same range and without replacement. The offer for any ticket in play is associated with a corresponding cost for the client device 24 to which that particular ticket has been provided. The cost is proportional to the expected gain that acceptance of the offer will provide to the client device 24 for that particular bingo ticket. The cost also includes a profit component for the operator of the bingo game.

Client device 24 may accept one or more offers made for the bingo tickets in play with which it has been provided. Client device 24 may provide a payment, prior to generation of the further random number, equal to the sum of the costs of all the accepted offers for that client device. Any bingo ticket for which the offer was not accepted during the iteration of the extended bingo match is no longer in play for the next iteration of the extended bingo match.

The extended bingo match proceeds with the server device 22 generating a further random number in the range 1 to 75 and transmitting this random number to a client device 24. If the generated random number appears on any of the bingo tickets in play provided to client device 24 for which an offer has been accepted, the corresponding grid positions on the bingo tickets are "marked off." Server device 22 then checks whether a winning pattern has occurred on any bingo ticket in play of any client device 24. Winning patterns may be the same intermediate patterns or the match-ending pattern as in the base portion of the bingo game. If none of the intermediate patterns or the match-ending pattern occur, server device 22 makes a further offer for each bingo ticket still in play, each such offer being associated with a corresponding new cost.

If the server device 22 detects the occurrence of an intermediate pattern, a prize associated with that intermediate pattern is credited to client device 24 on whose bingo ticket the intermediate pattern occurred. When server device 22 detects the occurrence of a match-ending pattern, the prize associated with the match-ending pattern is credited to the client device 24 on whose bingo ticket the match-ending pattern occurred. A bingo ticket on which an intermediate or the match-ending pattern occurred during the iteration of the extended bingo match is no longer in play for the next iteration of the extended bingo match.

If two or more client devices 24 achieve an intermediate pattern or a match-ending pattern on the same iteration of the extended bingo match, the associated prize may be shared equally among these client devices 24.

The extended bingo match terminates when either a) there are no more bingo tickets in play; b) no offers are accepted during an iteration of the extended bingo match; or c) no more random numbers in the range 1 to 75 remain to be generated.

A new networked bingo match may commence, and client devices 24 participating in the new networked bingo match may be each provided with at least one new bingo ticket.

B. 90-Symbol Networked Bingo Match

In this embodiment, the value of N for symbol sets 402 and 416 is 90 such that symbol sets 402 and 416 include 90 symbols numbered from 1 to 90, inclusive. Each bingo strip consists of 3 rows and 9 columns, such as strips 302 to 312. Each row has 5 numbered squares and 4 "free space" symbols that are not numbered. It will thus be appreciated that each bingo ticket may contain 15 grid positions, each of which is associated, randomly, with a number between 1 and 90 corresponding to one of the 90 symbols available in the bingo game. A set of 6 such bingo tickets is called a strip and, in such a strip, every number from 1 to 90 appears in a grid position only once. Therefore, for every ball drawn by server device 22, only 1 grid position will be marked across the 6 bingo tickets.

This embodiment of the bingo game has the same intermediate patterns and match-ending patterns as that of the 75-symbol embodiment described above.

Clearly, numerous variations and permutations are possible to the embodiments without departing from the scope of this disclosure. Some of these variations and permutations are described below.

In accordance with one or more of the disclosed embodiments, the extended portion of the networked bingo match may terminate after a predetermined maximum number of iterations, i.e. prior to the occurrence of any of the following additional termination conditions are met: a) there are no more bingo tickets in play; b) no offers in respect of bingo tickets in play are accepted during an iteration of the extended portion of the bingo match; and c) no more random numbers remain to be generated. For example, the extended portion of the bingo match may be limited to a maximum of 3 iterations. Alternatively, the extended portion of the bingo match may be restricted to a single iteration, i.e., only one additional symbol is called.

In accordance with one or more of the disclosed embodiments, instead of a single further symbol being called in an iteration of the extended portion of the bingo match that applies to all the bingo tickets in play, a separate further symbol may be called independently for each bingo ticket in play. In this embodiment, the extended portion of the networked bingo match becomes a set of separate, independent single-player bingo games with the starting condition of each single-player game determined by the symbols that have been called during the base portion of the networked bingo match, i.e., at the end of the base portion of the bingo match, each player would essentially be playing with his or her own set of remaining symbols.

XI. Conclusion

Example embodiments have been described above. Those skilled in the art will understand, however, that changes and modifications may be made to these embodiments without departing from the true scope of the invention, which is defined by the claims.

The invention claimed is:

1. A method comprising:

conducting, by a gaming server device, a real-time networked bingo game with a plurality of client devices, each client device associated with a respective bingo ticket, wherein the respective bingo tickets contain respective arrangements of symbols from a symbol set, wherein conducting the real-time networked bingo game comprises: (i) randomly selecting, by the gaming server device, symbols from the symbol set, (ii) marking, by the gaming server device, the selected symbols on any bingo tickets, of the respective bingo tickets, that contain the selected symbols, and (iii) repeating, by the gaming server device, the random selecting and marking until one or more of the respective bingo tickets are marked with a winning pattern;

transmitting, by the gaming server device, indications of awarded prizes to client devices associated with the bingo tickets marked with the winning pattern;

determining, by the gaming server device, to provide an offer to a particular client device associated with a particular bingo ticket that is not marked with the winning pattern, wherein the offer is for the gaming server device to randomly select a further symbol from the symbol set;

calculating, in real-time and by the gaming server device, an expected gain that acceptance of the offer provides to the particular client device, wherein the expected pain is based on a weighted average of: gains associated with outcomes of selection of particular further symbols respectively multiplied by corresponding probabilities of the particular further symbols being selected;

calculating, in real-time and by the gaming server device, a cost to the particular client device, wherein the cost is based on the expected gain;

transmitting, by the gaming server device, a representation of the cost to the particular client device; and receiving, by the gaming server device, the acceptance of the offer.

2. The method of claim 1, wherein the cost is proportional to the expected gain.

3. The method of claim 1, wherein the cost includes a rake amount that is provided to an operator of the bingo game.

4. The method of claim 1 further comprising:

in response to receiving acceptance of the offer, randomly selecting the further symbol from the symbol set.

5. The method of claim 4, wherein the further symbol is contained in the particular bingo ticket, the method further comprising:

marking the selected further symbol on the particular bingo ticket; and in the case that the particular bingo ticket is marked with a further winning pattern, transmitting an indication of a further awarded prize to the particular client device.

6. The method of claim 4, wherein the further symbol is not contained in the particular bingo ticket, the method further comprising:

transmitting a second offer to the particular client device, wherein the second offer is for the server device to randomly select a second further symbol from the symbol set at a second cost to the particular client device, and wherein the second cost is based on a second expected gain that acceptance of the second offer provides to the particular client device.

7. The method of claim 1, wherein transmitting the offer to the particular client device associated with the particular bingo ticket that is not marked with the winning pattern comprises:

transmitting individual offers to all client devices associated with bingo tickets that are not marked with the winning pattern, wherein each offer is associated with a respective cost to the respective client device, and wherein each respective cost is based on a respective expected gain that acceptance of the respective offer provides to the respective client device.

8. The method of claim 7, wherein at least 10 client devices are associated with bingo tickets that are not marked with the winning pattern, and wherein the gaming server device communicates with the at least 10 client devices in real time over a wide area network.

9. The method of claim 7, wherein the respective offers are for the server device to randomly select just one symbol from the symbol set.

10. The method of claim 7, wherein the respective offers are for the server device to randomly select different respective symbols from the symbol set for each respective client device.

11. The method of claim 1, wherein the particular client device is also associated with a second particular bingo ticket that is not marked with the winning pattern, and wherein transmitting the representation of the cost to the particular client device comprises:

transmitting a second representation of a second cost to the particular client device, wherein a second offer is associated with the second cost, and wherein the second cost is based on a second expected gain that acceptance of the second offer provides to the particular client device.

12. The method of claim 1, wherein a number of sequential offers made to the particular client device per match is limited to be no more than n, wherein n is between 1 and 5, inclusive.

13. The method of claim 1, wherein the symbol set consists of 75 or 90 symbols.

14. The method of claim 1, wherein the winning pattern is a match-ending pattern.

15. The method of claim 1, wherein the winning pattern is an intermediate pattern.

16. The method of claim 1, wherein the client devices include respective input mechanisms and display devices, wherein marking the selected symbols comprises transmitting, for display on the respective display devices, respective representations of the marked symbols, and wherein receiving acceptance of the offer is triggered by a particular input mechanism of the particular client device providing input representing acceptance of the offer.

17. The method of claim 1, wherein the client devices include respective input mechanisms and display devices, wherein conducting the real-time networked bingo game with the plurality of client devices comprises receiving input by way of the respective input mechanisms, and wherein transmitting the indications of awarded prizes to the client devices causes the client devices to display representation of the awarded prizes on their respective display devices.

18. An article of manufacture including a non-transitory computer-readable medium, having stored thereon program instructions that, upon execution by a gaming server device, cause the gaming server device to perform operations comprising:

conducting a real-time networked bingo game with a plurality of client devices, each client device associated with a respective bingo ticket, wherein the respective bingo tickets contain respective arrangements of symbols from a symbol set, wherein conducting the real-time networked bingo game comprises: (i) randomly selecting, by the gaming server device, symbols from the symbol set, (ii) marking, by the gaming server device, the selected symbols on any bingo tickets, of the respective bingo tickets, that contain the selected symbols, and (iii) repeating, by the gaming server device, the random selecting and marking until one or more of the respective bingo tickets are marked with a winning pattern;

transmitting indications of awarded prizes to client devices associated with the bingo tickets marked with the winning pattern;

determining to provide an offer to a particular client device associated with a particular bingo ticket that is not marked with the winning pattern, wherein the offer is for the gaming server device to randomly select a further symbol from the symbol set;

calculating, in real-time, an expected gain that acceptance of the offer provides to the particular client device, wherein the expected gain is based on a weighted average of: gains associated with outcomes of selection of particular further symbols respectively multiplied by corresponding probabilities of the particular further symbols being selected;

calculating, in real-time, a cost to the particular client device, and wherein the cost is based on the expected gain;

transmitting a representation of the cost to the particular client device; and receiving the acceptance of the offer.

19. A gaming system comprising:

a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more gaming device processors; and one or more gaming device memory devices storing (i) a plurality of bingo tickets, each associated with one of the gaming devices, wherein each bingo ticket of the plurality of bingo tickets contains a respective arrangement of symbols from a symbol set, and (ii) a plurality of gaming device instructions executable by the one or more gaming device processors to perform operations comprising:

conducting a real-time networked bingo game, wherein conducting the real-time networked bingo game comprises: (i) randomly selecting symbols from the symbol set, (ii) marking the selected symbols on any bingo tickets, of the respective bingo tickets, that contain the selected symbols, and (iii) repeating the random selecting and marking until one or more of the respective bingo tickets are marked with a winning pattern;

transmitting, for display on the respective display devices, indications of awarded prizes to client devices associated with the bingo tickets marked with the winning pattern;

determining to provide, for display on the respective display devices, an offer to a particular client device associated with a particular bingo ticket that is not marked with the winning pattern, wherein the offer is to randomly select a further symbol from the symbol set;

calculating, in real-time, an expected gain that acceptance of the offer provides to the particular client device, wherein the expected gain is based on a weighted average of: gains associated with outcomes of selection of particular further symbols respectively multiplied by corresponding probabilities of the particular further symbols being selected;

calculating, in real-time, a cost to the particular client device, and wherein the cost is based on the expected gain;

transmitting a representation of the cost to the particular client device; and receiving the acceptance of the offer.

* * * * *